US011519276B1

(12) United States Patent
Snider et al.

(10) Patent No.: US 11,519,276 B1
(45) Date of Patent: Dec. 6, 2022

(54) VIBRATION DAMPING SYSTEM FOR TURBINE BLADE OR NOZZLE, RETENTION SYSTEM THEREFOR, AND METHOD OF ASSEMBLY

(71) Applicant: General Electric Company, Schenectady, NY (US)

(72) Inventors: Zachary John Snider, Simpsonville, SC (US); John McConnell Delvaux, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/574,092

(22) Filed: Jan. 12, 2022

(51) Int. Cl.
*F01D 5/16* (2006.01)

(52) U.S. Cl.
CPC ..... *F01D 5/16* (2013.01); *F05D 2230/60* (2013.01)

(58) Field of Classification Search
CPC ..... F01D 25/06; F01D 5/16; F05D 2240/20; F05D 2230/60; F05D 2260/96
See application file for complete search history.

(56) References Cited

U.S. PATENT DOCUMENTS 3,778,184 A * 12/1973 Wood ..... F01D 9/042 416/190
5,498,137 A * 3/1996 El-Aini ..... F01D 5/16 416/500
5,820,343 A 10/1998 Kraft et al.
6,685,435 B2 * 2/2004 Davis ..... F01D 5/16 416/500
7,270,517 B2 9/2007 Garner
7,413,405 B2 8/2008 Busbey et al.
7,736,124 B2 6/2010 Bauer et al.
7,824,158 B2 11/2010 Bauer et al.
9,657,591 B2 5/2017 Schleif et al.
9,657,717 B2 5/2017 Ollgaard et al.
11,187,089 B2 11/2021 Wondrasek et al.
(Continued)

FOREIGN PATENT DOCUMENTS

JP 2014084676 A 5/2014

OTHER PUBLICATIONS

Ehrhard, Jan et al. "Exhaust Gas Turbocharger with Variable Turbine Geometry," European Patent Office, Jan. 30, 2020, 1-3 (Year: 2020).*

*Primary Examiner* — Brian P Wolcott
*Assistant Examiner* — Joshua R Beebe
(74) *Attorney, Agent, or Firm* — James Pemrick; Charlotte Wilson; Hoffman Warnick LLC

(57) ABSTRACT

A vibration damping element for a vibration damping system for a turbine nozzle or blade includes an elongated body and a wire mesh member that surrounds the elongated body. The wire mesh member has a first outer dimension in an inoperative state and a second, larger outer dimension in an operative state. In the operative state, the wire mesh member frictionally engages with an inner surface of a body opening in the turbine nozzle or blade to damp vibration. In the inoperative state, the wire mesh member slides freely in the body opening in the turbine nozzle or blade. A retention system includes a retention member on the elongated body that fixes the wire mesh member relative to a length of the elongated body in the operative state in the body opening of the turbine nozzle or blade.

18 Claims, 17 Drawing Sheets

(56) References Cited

U.S. PATENT DOCUMENTS

| | | | | |
|---|---|---|---|---|
| 2010/0166565 | A1* | 7/2010 | Uskert | F01D 5/10<br>416/241 B |
| 2010/0232968 | A1* | 9/2010 | Miller | F01D 5/26<br>416/190 |
| 2016/0090860 | A1* | 3/2016 | Schleif | F01D 25/04<br>415/119 |
| 2021/0172325 | A1 | 6/2021 | Wondrasek et al. | |
| 2021/0254478 | A1* | 8/2021 | Chakrabarti | F01D 5/16 |

* cited by examiner

VIBRATION DAMPING SYSTEM FOR TURBINE BLADE OR NOZZLE, RETENTION SYSTEM THEREFOR, AND METHOD OF ASSEMBLY

TECHNICAL FIELD

The disclosure relates generally to damping vibration in a turbine nozzle or blade. Further, the disclosure relates to a retention system for a wire mesh vibration damping member for a vibration damping system for turbine blades or nozzles.

BACKGROUND

One concern in turbine operation is the tendency of the turbine blades or nozzles to undergo vibrational stress during operation. In many installations, turbines are operated under conditions of frequent acceleration and deceleration. During acceleration or deceleration of the turbine, the airfoils of the blades are, momentarily at least, subjected to vibrational stresses at certain frequencies and in many cases to vibrational stresses at secondary or tertiary frequencies. Nozzle airfoils experience similar vibrational stress. Variations in gas temperature, pressure, and/or density, for example, can excite vibrations throughout the rotor assembly, especially within the nozzle or blade airfoils. Gas exiting upstream of the turbine and/or compressor sections in a periodic, or "pulsating" manner can also excite undesirable vibrations. When an airfoil is subjected to vibrational stress, its amplitude of vibration can readily build up to a point which may alter operations. Wire mesh vibration damping members can be used to dampen vibration but have a tendency to move from their initial position during operation of the turbine nozzle or blade.

BRIEF DESCRIPTION

All aspects, examples and features mentioned below can be combined in any technically possible way.

An aspect of the disclosure provides a vibration damping element for a vibration damping system for a turbine nozzle or blade, comprising: an elongated body; a wire mesh member surrounding the elongated body and having a first outer dimension in an inoperative state and a second, larger outer dimension in an operative state, wherein in the operative state, the wire mesh member frictionally engages with an inner surface of a body opening in the turbine nozzle or blade to damp vibration, and in the inoperative state, the wire mesh member slides freely in the body opening in the turbine nozzle or blade; and a retention member on the elongated body to fix a first section of the wire mesh member relative to a length of the elongated body in the operative state in the body opening of the turbine nozzle or blade.

Another aspect of the disclosure includes any of the preceding aspects, and the retention member includes a protrusion on a first portion of an outer surface of the elongated body, the protrusion engaging within an inner dimension of a mesh opening in the first section of the wire mesh member to create the second, larger outer dimension on the wire mesh member in the operative state.

Another aspect of the disclosure includes any of the preceding aspects, and the elongated body includes a second portion on the outer surface thereof, wherein the mesh opening in a second section of the wire mesh member different than the first section slides freely relative to the second portion.

Another aspect of the disclosure includes any of the preceding aspects, and the retention member includes a threaded section on a first portion of an outer surface of the elongated body, the threaded section having an outer dimension larger than an inner dimension of a mesh opening in the first section of the wire mesh member to create the second, larger outer dimension on the wire mesh member in the operative state.

Another aspect of the disclosure includes any of the preceding aspects, and the retention member includes a non-threaded section on a second portion on the outer surface of the elongated body, wherein the inner dimension of the mesh opening of the wire mesh member slides freely relative to the second portion.

Another aspect of the disclosure includes a vibration damping system for a turbine nozzle or blade, comprising: a body opening extending through a body of the turbine nozzle or blade between a tip end and a base end thereof; and a vibration damping element disposed in the body opening, the vibration damping element including: an elongated body having a first, free end and a second end fixed relative to one of the base end and the tip end; a wire mesh member surrounding the elongated body and having a first outer dimension in an inoperative state and a second, larger outer dimension in an operative state, wherein in the operative state, the wire mesh member frictionally engages with an inner surface of the body opening in the turbine nozzle or blade to damp vibration and in the inoperative state, the wire mesh member slides freely in the body opening in the turbine nozzle or blade; and a retention member on the elongated body configured to fix the wire mesh member relative to a length of the elongated body in the operative state in the body opening of the turbine nozzle or blade.

Another aspect of the disclosure includes any of the preceding aspects, and the retention member includes a protrusion on a first portion of an outer surface of the elongated body, the protrusion engaging with an inner dimension of a mesh opening in the first section of the wire mesh member to create the second, larger outer dimension on the wire mesh member in the operative state.

Another aspect of the disclosure includes any of the preceding aspects, and the retention member includes a second portion on the outer surface of the elongated body, wherein the inner dimension of the mesh opening in a second section of the wire mesh member different than the first section slides freely relative to the second portion.

Another aspect of the disclosure includes any of the preceding aspects, and the retention member includes a threaded section on a first portion of an outer surface of the elongated body, the threaded section having an outer dimension larger than an inner dimension of the wire mesh member in the first section of the wire mesh member to create the second, larger outer dimension on the wire mesh member in the operative state.

Another aspect of the disclosure includes any of the preceding aspects, and the elongated body includes a non-threaded section on a second portion on the outer surface of the elongated body, wherein the inner dimension of the mesh opening in a second section the wire mesh member different than the first section slides freely relative to the second portion.

Another aspect of the disclosure includes any of the preceding aspects, and the second end of the elongated body is fixed relative to the tip end of the body, and the first, free end extends towards the base end.

Another aspect of the disclosure includes any of the preceding aspects, and the second end of the elongated body is fixed relative to the base end of the body of the turbine nozzle or blade, and the first, free end extends towards the tip end.

Another aspect of the disclosure includes any of the preceding aspects, and the wire mesh member includes a plurality of wire mesh members spaced along the elongated body, each wire mesh member engaging with a different portion of the inner surface of the body opening.

Another aspect includes a method of assembling a vibration damping system in a turbine nozzle or blade, the method comprising: positioning a wire mesh member in a body opening extending through a body of the turbine nozzle or blade between a tip end and a base end thereof, the wire mesh member having a mesh opening therein having an inner dimension and a first outer dimension that slides freely in the body opening in the turbine nozzle or blade in an inoperative state; positioning an elongated body in the body opening and within the mesh opening of the wire mesh member, wherein a retention member on the elongated body fixes a first section of the wire mesh member relative to a length of the elongated body in an operative state in the body opening of the turbine nozzle or blade by creating a second, larger outer dimension in the wire mesh member that frictionally engages with an inner surface of the body opening in the turbine nozzle or blade; and fixing the elongated body relative to one of the base end and the tip end such that the elongated body has a first, free end and a second end fixed relative to the one of the base end and the tip end.

Another aspect of the disclosure includes any of the preceding aspects, and the retention member includes a protrusion on a first portion of an outer surface of the elongated body, and the positioning of the elongated body includes engaging the protrusion within the inner dimension of the mesh opening in the first section of the wire mesh member to create the second, larger outer dimension on the wire mesh member.

Another aspect of the disclosure includes any of the preceding aspects, and the retention member includes a second portion on the outer surface of the elongated body, wherein the inner dimension of the mesh opening of a second section of the wire mesh member different than the first section slides freely relative to the second portion.

Another aspect of the disclosure includes any of the preceding aspects, and the retention member includes a threaded section on a first portion of an outer surface of the elongated body, the threaded section having an outer dimension larger than the inner dimension of the mesh opening in the first section of the wire mesh member, and wherein the positioning of the elongated body includes threading the first portion into the mesh opening to create the second, larger outer dimension on the wire mesh member.

Another aspect of the disclosure includes any of the preceding aspects, and the retention member includes a non-threaded section on a second portion on the outer surface of the elongated body, wherein the inner dimension of the mesh opening in a second section of the wire mesh member different than the first section slides freely relative to the second portion.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
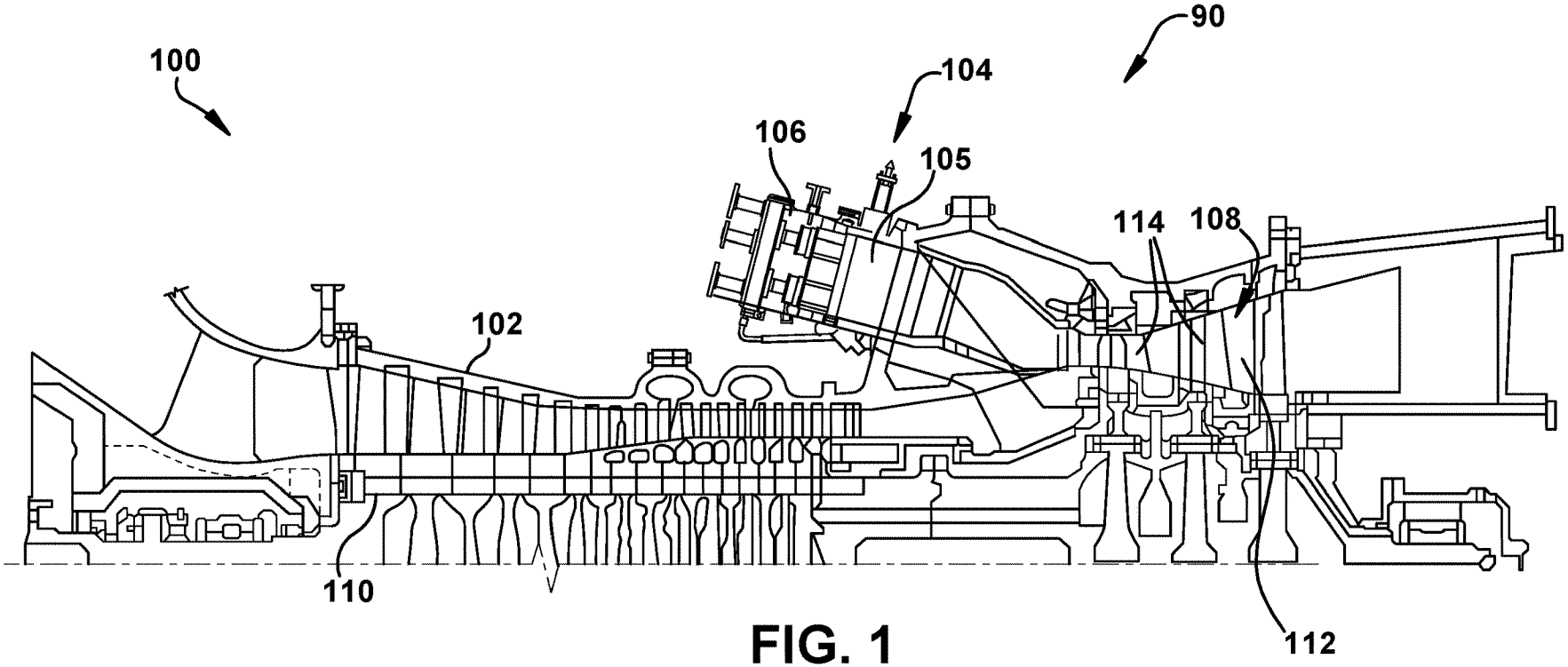
FIG. 1 shows a simplified cross-sectional view of an illustrative turbomachine in the form of a gas turbine system.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a turbine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine.

It is often required to describe parts that are disposed at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Embodiments of the disclosure provide vibration damping systems for a turbine nozzle (vane) or turbine blade. The systems may include a body opening extending through a body of the turbine nozzle or blade between the tip end and the base end thereof, e.g., through the airfoil among potentially other parts of the nozzle or blade. A vibration damping element is disposed in the body opening and includes one or more elongated bodies each having a first, free end and a second end fixed relative to the base end or the tip end. At least one wire mesh member surrounds the elongated body(ies). A retention system may be used to facilitate assembly, retain the wire mesh member(s) relative to a length of the elongated body, and/or retain the body opening in the turbine nozzle or blade.

The wire mesh member has a first outer dimension (ODM1) in an inoperative state and a second, larger outer dimension (ODM2) in an operative state. In an inoperative state, the wire mesh member slides freely in the body opening in the turbine nozzle or blade for assembly. In an operative state, the wire mesh member(s) frictionally engages with an inner surface of the body opening in the turbine nozzle or blade to damp vibration. The wire mesh member(s) may be retained in the operative state by the retention system that includes a retention member on the elongated body. The retention member fixes the wire mesh member relative to a length of the elongated body in the body opening of the turbine nozzle or blade. Additionally, in the operative state, the wire mesh member frictionally engages with an inner surface of the body opening to damp vibration. Related methods of operation and assembly are also disclosed.

A vibration damping system may also include a vibration damping element including a plurality of contacting members including a plurality of damper pins. Each damper pin includes a body, and a wire mesh member surrounds the body of at least one of the plurality of damper pins. The wire mesh member has an outer dimension sized for frictionally engaging within a body opening in the turbine nozzle or blade to damp vibration. The plurality of contacting members may also include a spacing member that is devoid of a wire mesh member. The damper pins can have different sizes to accommodate contiguous body openings of different sizes in the nozzle or blade, reducing the weight of the vibration damping element. In this setting, the body opening can also be angled relative to a radial extent of the turbine nozzle or blade.

The vibration damping systems including the wire mesh member(s) reduce nozzle or blade vibration with a simple arrangement and do not add much extra mass to the nozzle or blade. Accordingly, the systems do not add additional centrifugal force to the nozzle base end or blade tip end or require a change in nozzle or blade configuration.

Referring to the drawings, FIG. 1 is a schematic view of an illustrative machine including a turbine(s) to which teachings of the disclosure can be applied. In FIG. 1, a turbomachine 90 in the form of a combustion turbine or gas turbine (GT) system 100 (hereinafter, "GT system 100") is shown. GT system 100 includes a compressor 102 and a combustor 104. Combustor 104 includes a combustion region 105 and a fuel nozzle section 106. GT system 100 also includes a turbine 108 and a common compressor/turbine shaft 110 (hereinafter referred to as "rotor 110"). GT system 100 may be a 7HA.03 engine, commercially available from General Electric Company, Greenville, S.C. The present disclosure is not limited to any one particular GT system and may be implemented in connection with other engines including, for example, the other HA, F, B, LM, GT, TM and E-class engine models of General Electric Company and engine models of other companies. More importantly, the teachings of the disclosure are not necessarily applicable to only a turbine in a GT system and may be applied to practically any type of industrial machine or other turbine, e.g., steam turbines, jet engines, compressors (as in FIG. 1), turbofans, turbochargers, etc. Hence, reference to turbine 108 of GT system 100 is merely for descriptive purposes and is not limiting.

Figure 2:
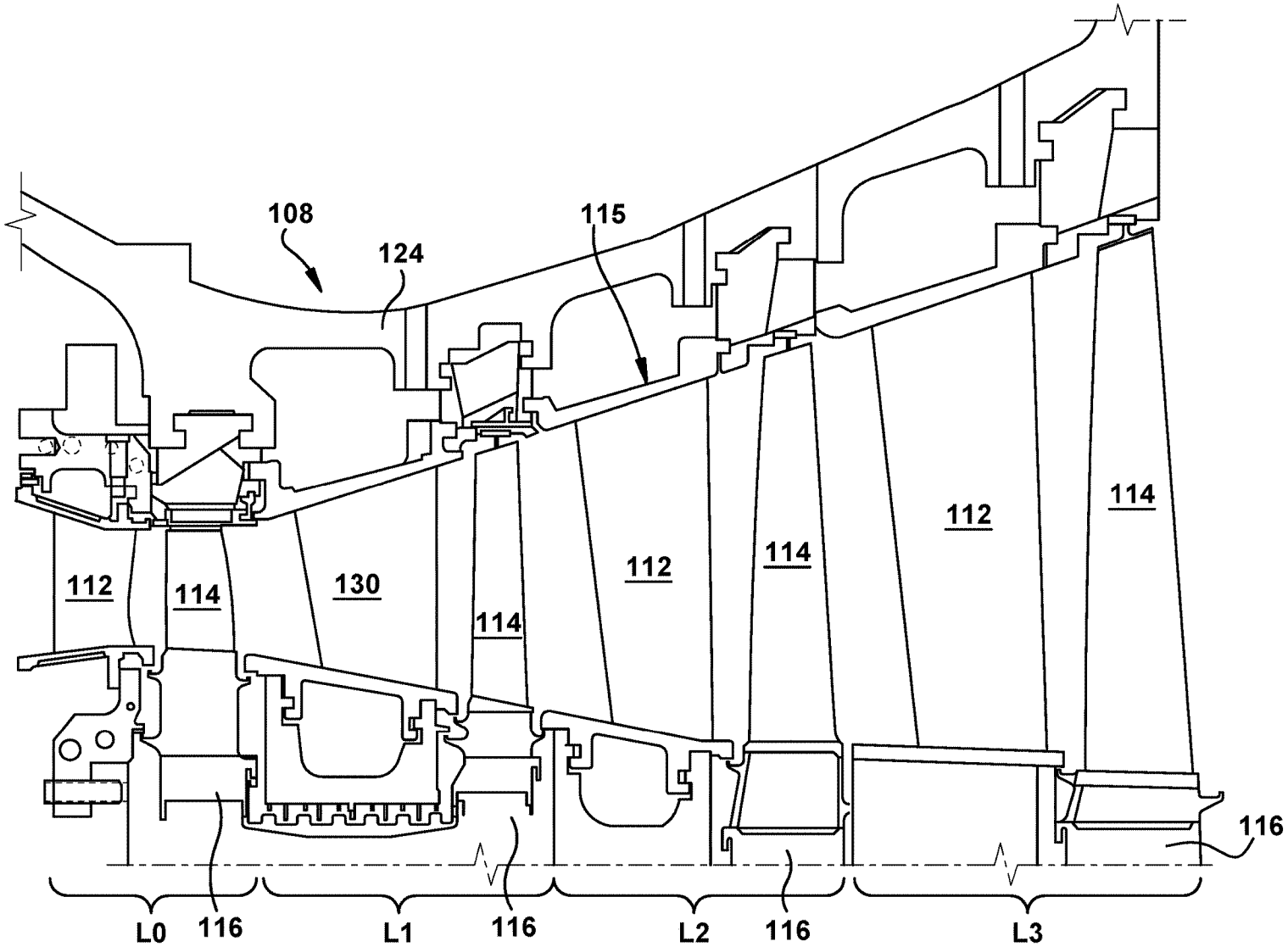
FIG. 2 shows a cross-sectional view of a portion of an illustrative turbine, according to embodiments of the disclosure.

FIG. 2 shows a cross-sectional view of an illustrative portion of turbine 108. In the example shown, turbine 108 includes four stages L0-L3 that may be used with GT system 100 in FIG. 1. The four stages are referred to as L0, L1, L2, and L3. Stage L0 is the first stage and is the smallest (in a radial direction) of the four stages. Stage L1 is the second stage and is disposed adjacent the first stage L0 in an axial direction. Stage L2 is the third stage and is disposed adjacent the second stage L1 in an axial direction. Stage L3 is the fourth, last stage and is the largest (in a radial direction). It is to be understood that four stages are shown as one example only, and each turbine may have more or less than four stages.

A plurality of stationary turbine vanes or nozzles 112 (hereafter "nozzle 112," or "nozzles 112") may cooperate with a plurality of rotating turbine blades 114 (hereafter "blade 114," or "blades 114") to form each stage L0-L3 of turbine 108 and to define a portion of a working fluid path through turbine 108. Blades 114 in each stage are coupled to rotor 110 (FIG. 1), e.g., by a respective rotor wheel 116 that couples them circumferentially to rotor 110 (FIG. 1). That is, blades 114 are mechanically coupled in a circumferentially spaced manner to rotor 110, e.g., by rotor wheels 116. A static nozzle section 115 includes a plurality of stationary nozzles 112 circumferentially spaced around rotor 110 (FIG. 1). It is recognized that blades 114 rotate with rotor 110 (FIG. 1) and thus experience centrifugal force, while nozzles 112 are static.

With reference to FIGS. 1 and 2, in operation, air flows through compressor 102, and pressurized air is supplied to combustor 104. Specifically, the pressurized air is supplied to fuel nozzle section 106 that is integral to combustor 104. Fuel nozzle section 106 is in flow communication with combustion region 105. Fuel nozzle section 106 is also in flow communication with a fuel source (not shown in FIG. 1) and channels fuel and air to combustion region 105. Combustor 104 ignites and combusts fuel to produce combustion gases. Combustor 104 is in flow communication with turbine 108, within which thermal energy from the combustion gas stream is converted to mechanical rotational energy by directing the combusted fuel (e.g., working fluid) into the working fluid path to turn blades 114. Turbine 108 is rotatably coupled to and drives rotor 110. Compressor 102 is rotatably coupled to rotor 110. At least one end of rotor 110 may extend axially away from compressor 102 or turbine 108 and may be attached to a load or machinery (not shown), such as, but not limited to, a generator, a load compressor, and/or another turbine.

Figure 3:
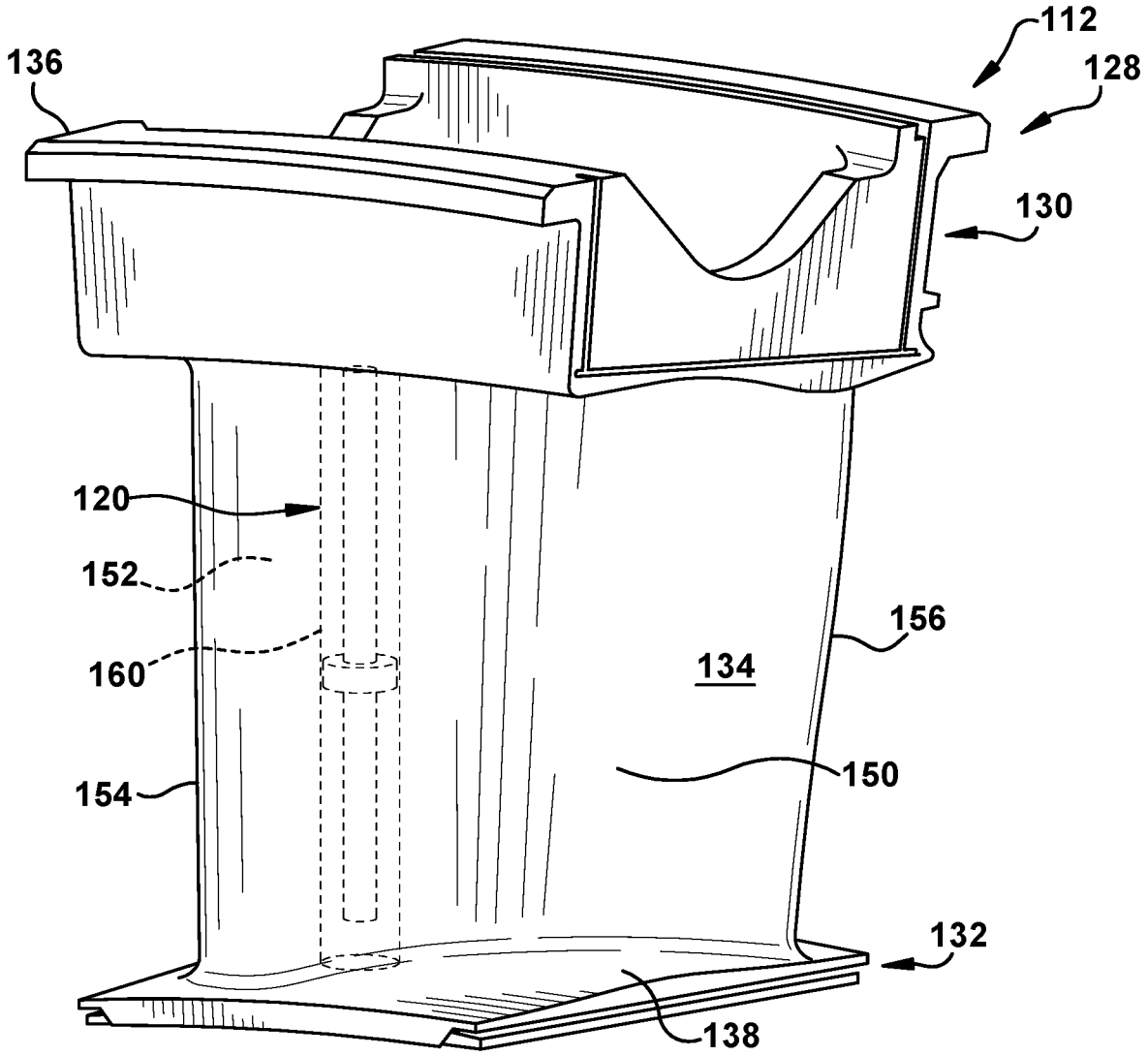
FIG. 3 shows a perspective view of an illustrative turbine nozzle including a vibration damping system, according to embodiments of the disclosure.
Figure 4:
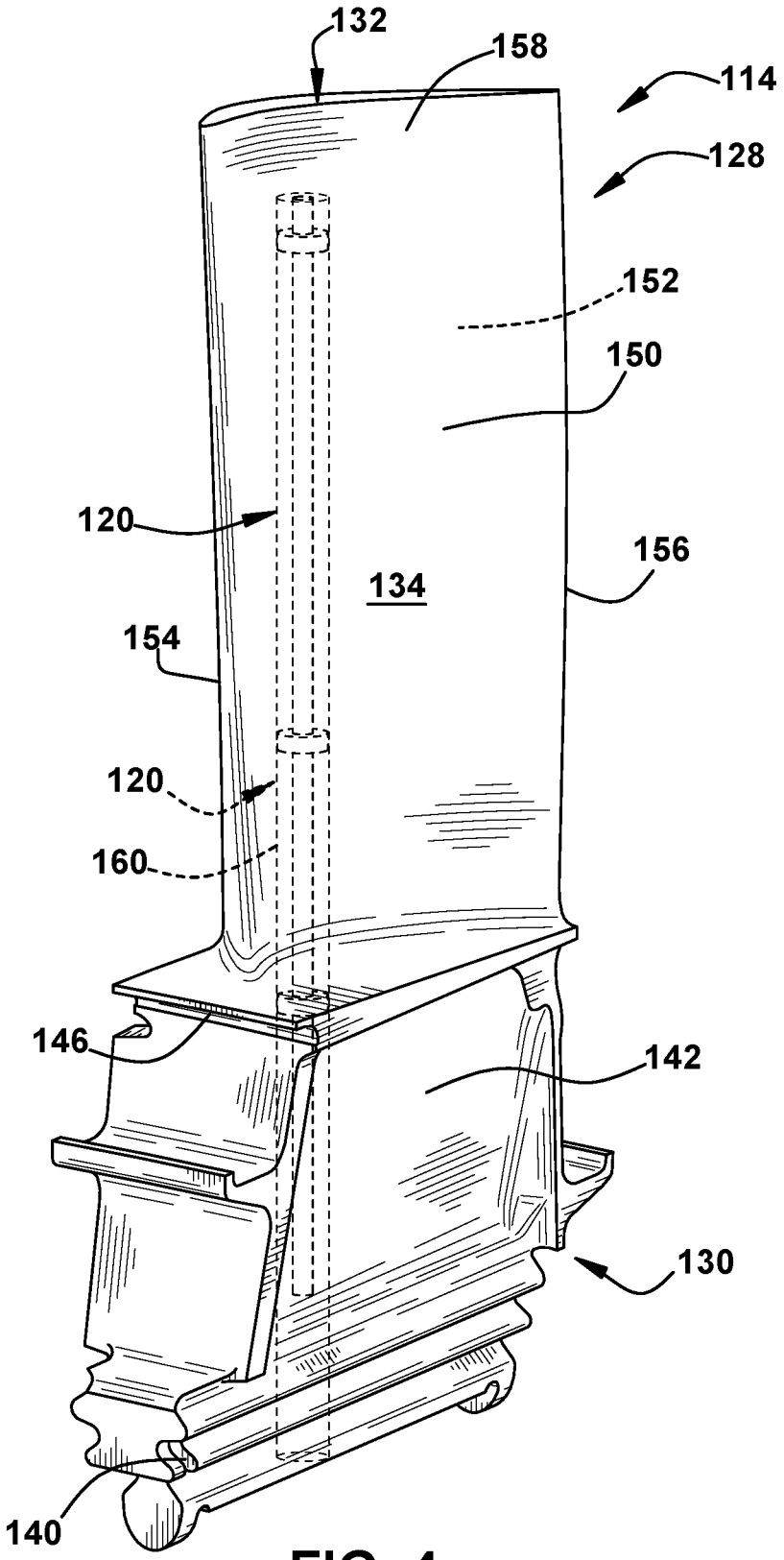
FIG. 4 shows a perspective view of an illustrative turbine blade including a vibration damping system, according to embodiments of the disclosure.
Figure 5:
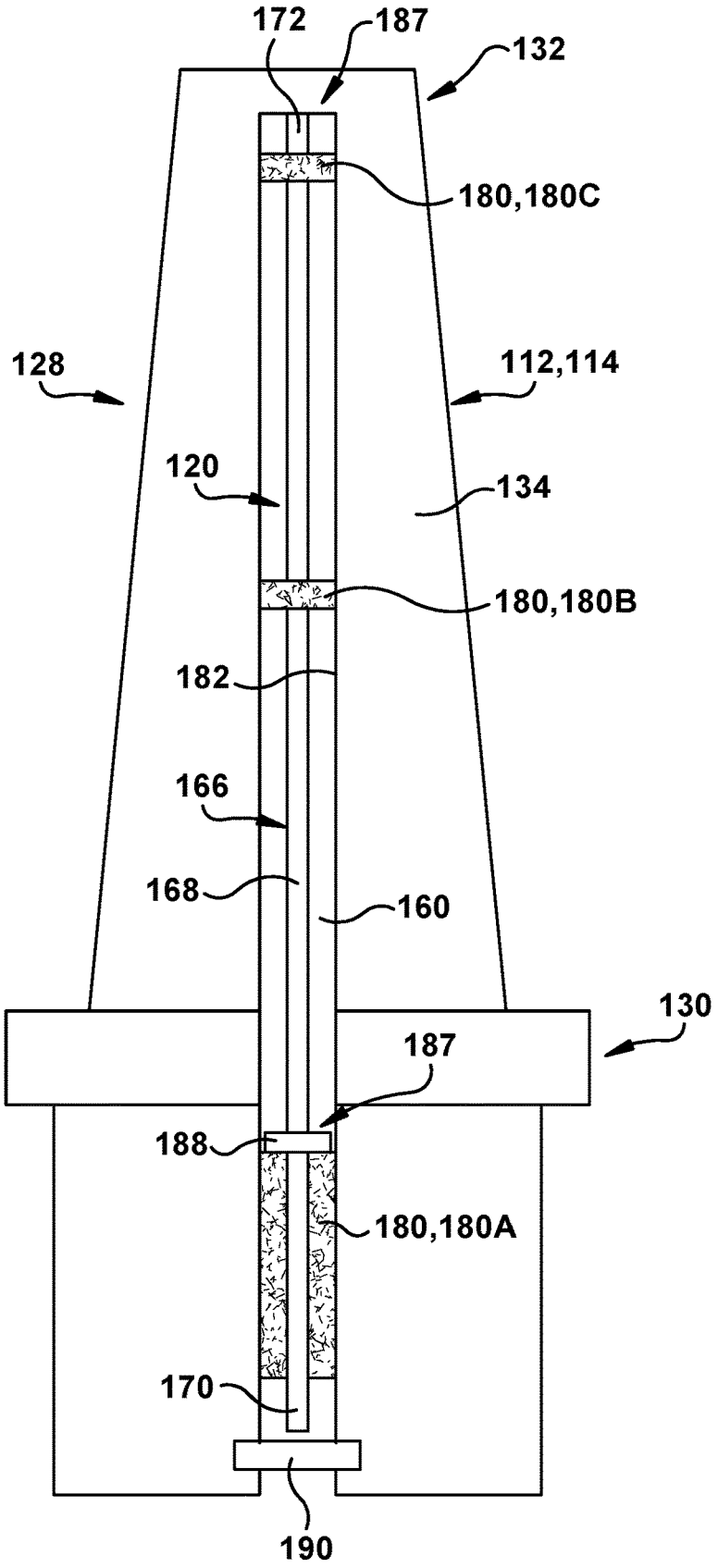
FIG. 5 shows a schematic cross-sectional view of a turbine nozzle or blade having a vibration damping system, according to embodiments of the disclosure.
Figure 6:
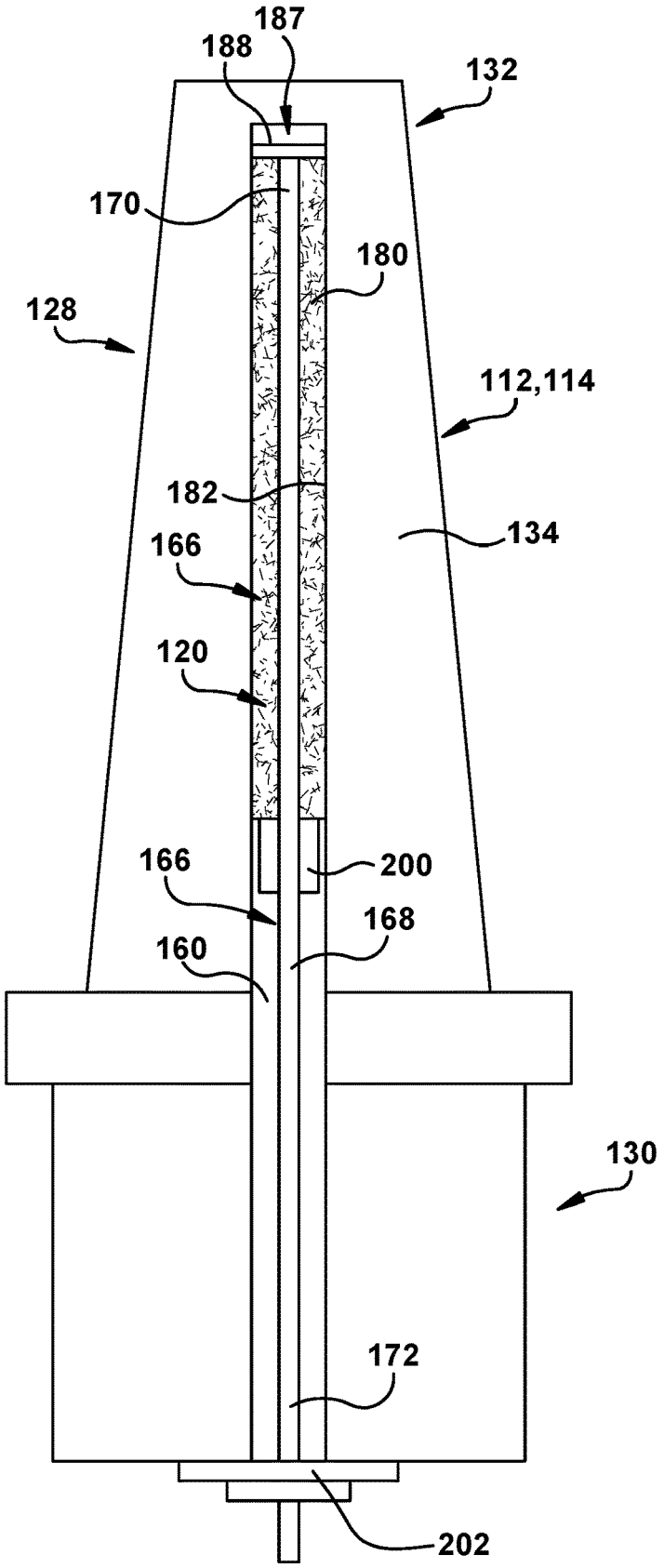
FIG. 6 shows a schematic cross-sectional view of a turbine nozzle or blade having a vibration damping system, according to other embodiments of the disclosure.
Figure 7:
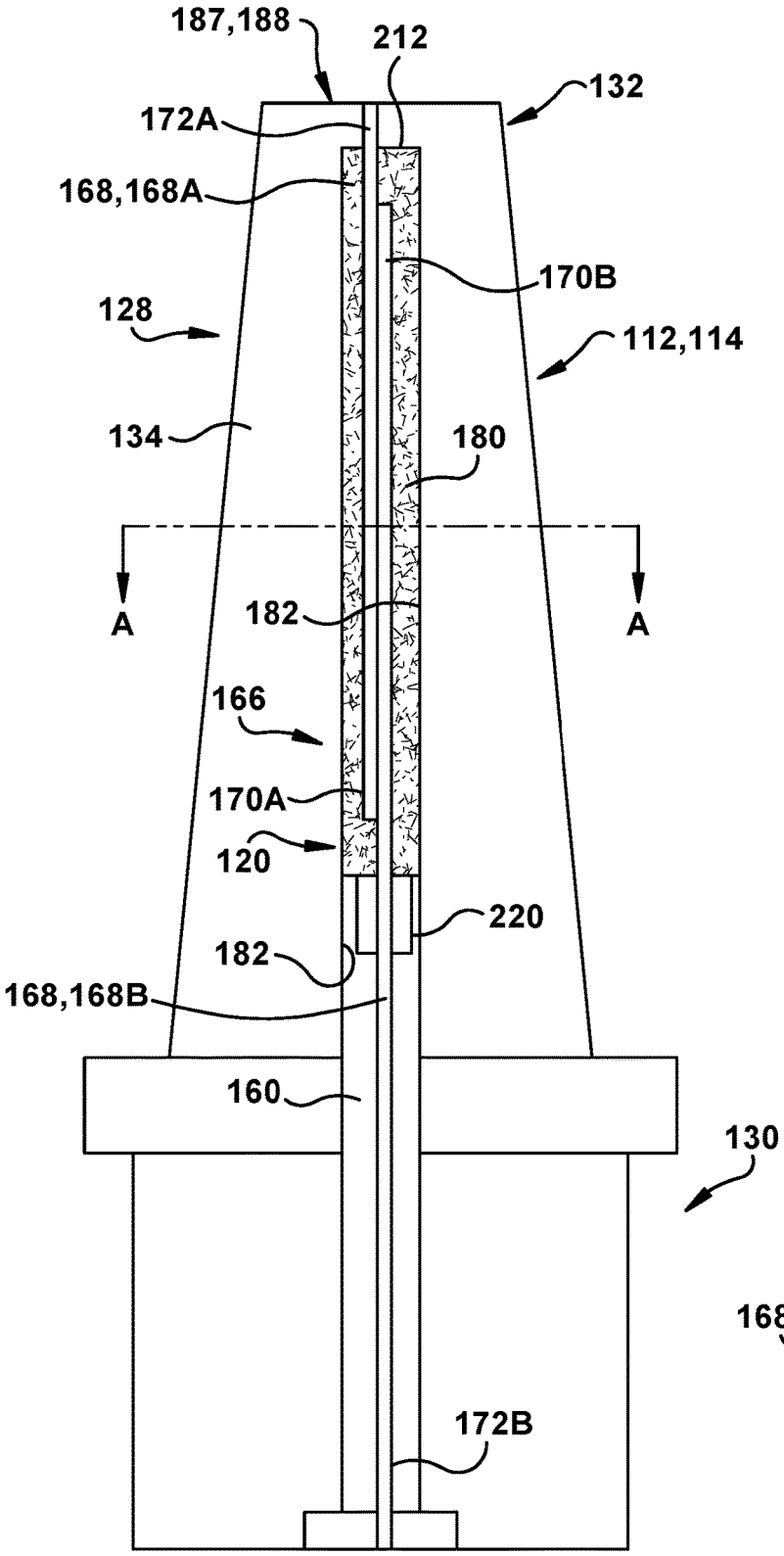
FIG. 7 shows a schematic cross-sectional view of a turbine nozzle or blade having a vibration damping system, according to additional embodiments of the disclosure.

FIGS. 3 and 4 show perspective views, respectively, of a (stationary) nozzle 112 or (rotating) blade 114, of the type in which embodiments of a vibration damping system 120 and vibration damping element 166 of the present disclosure may be employed. As will be described herein, FIGS. 5-7 show schematic cross-sectional views of a nozzle 112 or blade 114 including vibration damping system 120.

Referring to FIGS. 3 and 4, each nozzle or blade 112, 114 includes a body 128 having a base end 130, a tip end 132, and an airfoil 134 extending between base end 130 and tip end 132. As shown in FIG. 3, nozzle 112 includes an outer endwall 136 at base end 130 and an inner endwall 138 at tip end 132. Outer endwall 136 couples to casing 124 (FIG. 2). As shown in FIG. 4, blade 114 includes a dovetail 140 at base end 130 by which blade 114 attaches to a rotor wheel 116 (FIG. 2) of rotor 110 (FIG. 2). Base end 130 of blade 114 may further include a shank 142 that extends between dovetail 140 and a platform 146. Platform 146 is disposed at the junction of airfoil 134 and shank 142 and defines a portion of the inboard boundary of the working fluid path (FIG. 2) through turbine 108.

It will be appreciated that airfoil 134 in nozzle 112 and blade 114 is the active component of the nozzle 112 or blade 114 that intercepts the flow of working fluid and, in the case of blades 114, induces rotor 110 (FIG. 1) to rotate. It will be seen that airfoil 134 of nozzle 112 and blade 114 include a concave pressure side (PS) outer wall 150 and a circumferentially or laterally opposite convex suction side (SS) outer wall 152 extending axially between opposite leading and trailing edges 154, 156, respectively. Sidewalls 150 and 152 also extend in the radial direction from base end 130 (i.e., outer endwall 136 for nozzle 112 and platform 146 for blade 114) to tip end 132 (i.e., inner endwall 138 for nozzle 112 and a tip end 158 for blade 114). Note, in the example shown, blade 114 does not include a tip shroud; however, teachings of the disclosure are equally applicable to a blade including a tip shroud at tip end 158.

As noted, during operation of a turbine, nozzles 112 or blades 114 may be excited into vibration by a number of different forcing functions. Variations in, for example, working fluid temperature, pressure, and/or density can excite vibrations throughout the rotor assembly, especially within the airfoils and/or tips of the blades or nozzles. Gas exiting upstream of the turbine and/or compressor sections in a periodic, or "pulsating," manner can also excite undesirable vibrations. The present disclosure aims to reduce the vibration of a stationary turbine nozzle 112 or rotating turbine blade 114 without significant change of nozzle or blade design.

Referring to FIGS. 5-7, schematic cross-sectional views of nozzle 112 or blade 114 including vibration damping system 120 are illustrated. (Nozzle 114 in the schematic view of FIGS. 5-7 is shown flipped vertically compared to that shown in FIG. 3 and without the inner endwall 138, for ease of description.) Vibration damping system 120 for turbine nozzle 112 or blade 114 may include a body opening 160 extending through body 128 between tip end 132 and base end 130 thereof and through airfoil 134. Body opening 160 may extend part of the distance between base end 130 and tip end 132, or it may extend through one or more of base end 130 or tip end 132. Body opening 160 may be defined in any part of any structure of body 128. For example, where body 128 includes an internal partition wall (not shown), for example, for defining a cooling circuit therein, body opening 160 may be defined as an internal cavity in the partition wall in body 128. Body opening 160 generally extends radially in body 128. However, as will be described herein, some angling, and perhaps curving, of body opening 160 relative to a radial extent of body 128 is possible.

Vibration damping system 120 for nozzles 112 or blades 114 may also include a vibration damping element 166 disposed in body opening 160. Vibration damping element 166 may include one or more elongated bodies 168 each including a first, free end 170 and a second end 172 fixed relative to base end 130 or tip end 132. Body opening 160 has a dimension greater than a corresponding outer dimension of elongated body(ies) 168, allowing elongated body(ies) 168 a limited movement range within body opening 160 to dampen vibrations through deflection thereof within body opening 160. Elongated body(ies) 168 may damp vibration by deflection thereof in body opening 160 as they extend radially between tip end 132 and base end 130 of body 128 of turbine nozzle 112 or blade 114.

Elongated body(ies) 168 may have any length desired to provide a desired deflection and vibration damping within nozzle 112 or blade 114 and, as will be described, to engage with any number of wire mesh members 180. Elongated body(ies) 168 may have any desired cross-sectional shape to provide a desired vibration damping within nozzle 112 or blade 114. For example, elongated body(ies) 168 may have a circular or oval cross-sectional shape, i.e., they are cylindrical or rod shaped (see e.g., FIGS. 10 and 11). However, other cross-sectional shapes are also possible. Elongated body(ies) 168 may be made of any material having the desired vibration resistance required for a particular application, e.g., a metal or metal alloy. In some embodiments, elongated body(ies) 168 may need to be very rigid or stiff, which could require alternative stiffer materials than metal or metal alloy such as, but not limited to, ceramic matrix composites (CMC).

Figure 8:
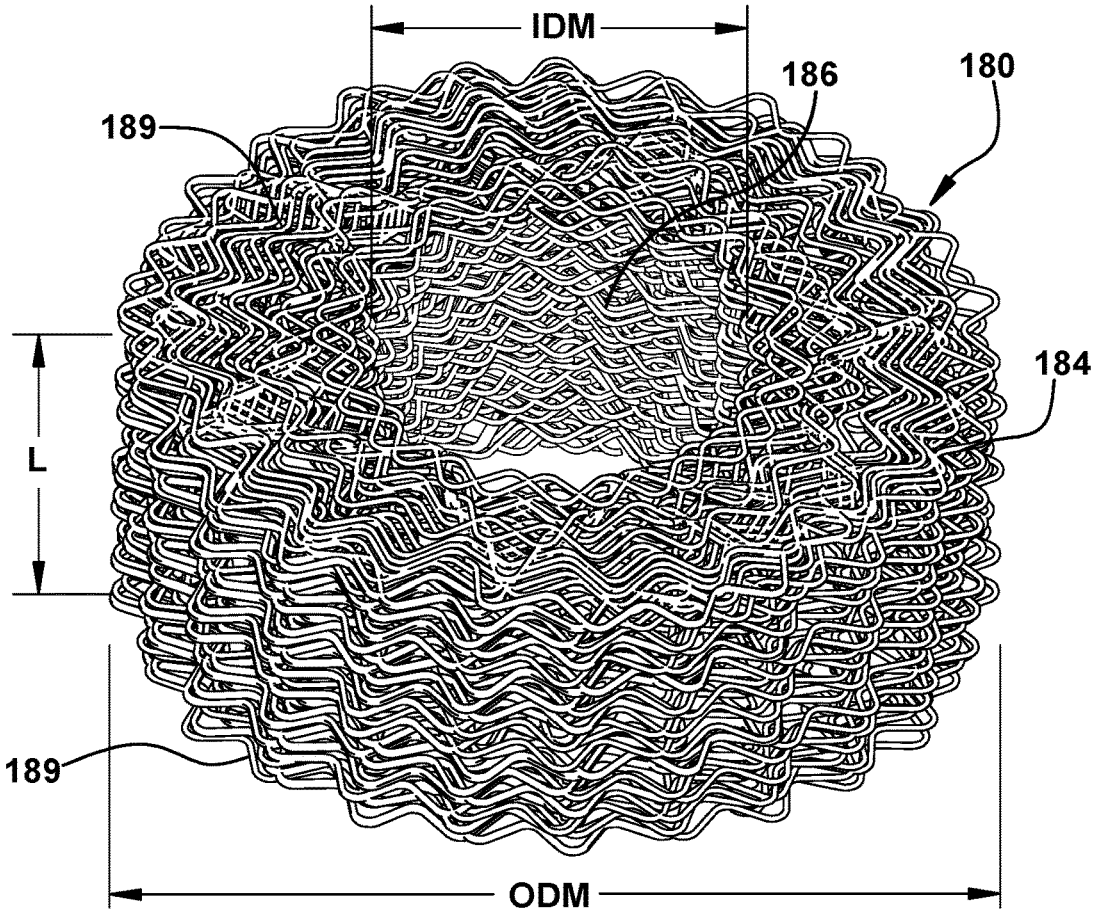
FIG. 8 shows a perspective view of a wire mesh member, according to embodiments of the disclosure.
Figure 9:
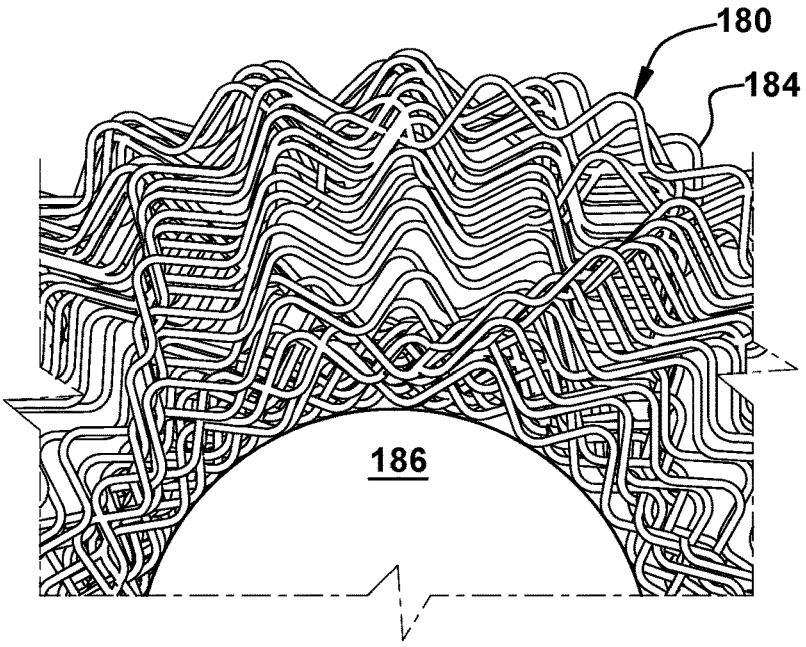
FIG. 9 shows an enlarged view of a wire mesh member, according to embodiments of the disclosure.

Vibration damping element 166 of vibration damping system 120 also includes at least one wire mesh member 180 surrounding each elongated body 168. As will be further described, wire mesh member(s) 180 frictionally engages with an inner surface 182 of body opening 160 to damp vibration. FIG. 8 shows a perspective view, and FIG. 9 shows an enlarged partial view of an illustrative wire mesh member 180. Wire mesh member 180 includes any now known or later developed wire mesh damping material suitable for restricting movement of elongated body(ies) 168. As will be described herein, wire mesh member(s) 180 may also surround damper pins 252 (FIGS. 17-25) in other embodiments of the disclosure. Wire mesh member(s) 180 may also be coated in various coating materials to alter frictional properties thereof. Wire mesh member 180 may be referred to as 'metal rubber.' As shown in FIGS. 8 and 9, wire mesh member(s) 180 may include a knitted wire-mesh material 184.

As will be described in greater detail herein, wire mesh member(s) 180 surround elongated body(ies) 168 or a damper pin 252 (FIGS. 17-25). More particularly, a mesh opening 186 in wire mesh member(s) 180 has a shape and dimensions to surround one elongated body 168, numerous elongated bodies 168A-B (see e.g., FIGS. 10 and 11), or a body 260 of a damper pin 252 (FIGS. 17-25). In the examples shown in FIGS. 8 and 9, mesh opening 186 is circular and has an inner dimension (IDM), e.g., inner diameter, sized to surround an elongated body 168 or body 260 of damper pin 252 (FIGS. 17-25). Other shapes are also possible.

As will be further described, an outer shape of wire mesh member(s) 180 is shaped and dimensioned to fit snugly within body opening 160 in an operative state. For example, wire mesh member(s) 180 may have an outer dimension (ODM), e.g., outer diameter, configured to have an interference fit within body opening 160 of turbine nozzle 112 or blade 114 in an operative state. In the example shown, wire mesh member(s) 180 and body opening 160 have circular cross-sections; however, other shapes are also possible, e.g., polygonal, oval, etc.

Wire mesh member(s) 180 may be stiff, but still compliant in the radial and axial direction thereof. In this manner, wire mesh member(s) 180 provides damping of vibration by frictional engagement thereof with inner surface 182 of body opening 160 in an operative state. The length L of wire mesh member(s) 180 can be customized for the particular application. Any number of wire mesh member(s) 180 can be used, i.e., one or more. Where a plurality of wire mesh members 180 are used, they may be spaced along elongated body(ies) 168. Each wire mesh member 180 may thus engage with a different portion of inner surface 182 of body opening 160 and a different portion of a respective elongated body 168. In certain embodiments, two or more wire mesh members 180 may axially engage with one another to collectively form a longer, stacked wire mesh member.

Wire mesh member(s) 180 may be retained with retention member(s) 188 relative to a length of elongated body 168 or damper pin 252 (FIGS. 17-25). While wire mesh member(s) 180 are retained in this manner, it will be recognized that the wire mesh member(s) 180 move a limited amount as part of their function. In embodiments where a single wire mesh member 180 with a single retention member 188 is illustrated (e.g., FIGS. 6 and 7), it will be recognized that the wire mesh member 180 may include two or more spaced wire mesh members 180 each with their own retention member 188.

Vibration damping system 120 using a vibration damping element 166 with elongated body 168 can take a number of forms. FIGS. 5 and 6 show embodiments in which a single elongated body 168 is used, and FIG. 7 shows an embodiment in which more than one elongated body 168 is used.

FIG. 5 shows an embodiment in which second end 172 of elongated body 168 is fixed relative to tip end 132 of body 128, and first, free end 170 extends towards base end 130. Second end 172 may be fixed within outer endwall 136 (FIG. 3) of nozzle 112 or within tip end 158 (FIG. 4) of blade 114. While the single elongated body 168 is shown having free end 170 thereof extending into base end 130, i.e., into inner endwall 138 (FIG. 3) of nozzle 112 or into shank 142 (FIG. 4) of blade 114, that is not necessary in all cases. Second end 172 may be fixed in any now known or later developed manner. In one example, where used in turbine blade 114, second end 172 can be fixed by radial loading during operation of turbine 108 (FIGS. 1-2), i.e., by centrifugal force. In another example, second end 172 may be physically fixed, e.g., by fastening using couplers, fasteners, and/or welding. For example, an elongated body 168A (shown in FIG. 7) includes second end 172 that may be physically fixed in tip end 132 by threaded fasteners (not shown).

Wire mesh member(s) 180 may be retained in position or limited in movement using a number of techniques. In accordance with embodiments of the disclosure, a retention system 187 may include a retention member 188 on elongated body 168 to fix wire mesh member(s) 180 relative to a length of elongated body 168 in an operative state in body opening 160 of turbine nozzle 112 or blade 114. In one example shown in FIG. 5, retention member 188 extends from elongated body 168 to engage an end 189 (FIG. 8) of wire mesh member(s) 180 to allow limited sliding movement (and limited compression) of at least one wire mesh member 180A relative to a length of elongated body 168 (i.e., longitudinally along elongated body 168) and radially relative to an axis of turbine 108 (FIG. 1). In some cases, retention member(s) 188 also prevents wire mesh member(s) 180 from moving off elongated body 168. As illustrated in FIG. 5, where other wire mesh members 180B, 180C are optionally provided, retention members 188 may not be necessary. In another example, as shown in FIG. 7, for turbine blades 114, tip end 132 may retain wire mesh member 180C against centrifugal force of the rotating blade. Alternative forms of a retention member 188 will be described herein.

Body opening 160 may terminate in base end 130, or as shown in FIGS. 5-7, it may extend through base end 130. The latter scenario may assist in assembly of vibration damping system 120 in nozzle 112 or blade 114 and may allow retrofitting of the system into an existing nozzle or blade. Where body opening 160 extends through base end 130, as shown in FIG. 5, a closure 190 for body opening 160 in base end 130 may be provided. Closure 190 may also be employed to retain and/or direct elongated body 168 into an operational state within body opening 160.

In the FIG. 5 embodiment, vibration damping system 120 operates with second end 172 of elongated body 168 moving with tip end 132, i.e., with airfoil 134, driving relative motion with base end 130 of nozzle 112 or blade 114. Here, vibration damping system 120 allows vibration damping through deflection of elongated body 168 and frictional engagement of wire mesh member(s) 180 with inner surface 182 of body opening 160. For turbine blades 114, this arrangement may also advantageously present lower radial force (G-load) on wire mesh member(s) 180 because of the presence of wire mesh member 180A in base end 130 rather than tip end 132. Wire mesh member(s) 180A in base end 130 may result in less compression of member(s) 180 in turbine blade 114, thus extending their useful life for blades 114. In nozzles or blades, base end 130 may also provide lower temperatures, which could be beneficial for longevity of the system.

Referring to FIG. 6, in another embodiment, second end 172 of elongated body 168 is fixed relative to base end 130 of body 128 of turbine nozzle 112 or blade 114, and first, free end 170 extends towards tip end 132. Any number of wire mesh member(s) 180 (one or a plurality) may be retained from sliding movement along the elongated body 168 using any now known or later developed retention member(s) 188. In one example, retention member 188 may be positioned on elongated body 168 (i.e., radial outer end thereof) to prevent wire mesh member(s) 180 from moving relative to a length of elongated body 168, e.g., because of centrifugal force.

For turbine blades 114, vibration damping system 120 may also optionally include a compression member 200 movable along elongated body 168 to compress wire mesh member(s) 180 against retention member 188 during operation of turbine nozzle 112 or blade 114, i.e., beyond the compression provided by centrifugal force of the rotating blades 114. The compression adds force to the frictional engagement of wire mesh member(s) 180 with inner surface 182 of body opening 160 to provide additional vibration damping. Wire mesh member(s) 180 is/are positioned between retention member 188 and compression member 200. Compression member 200 may include any form of movable weight that can compress wire mesh member(s) 180, e.g., as caused by the application of centrifugal force on blade 114 during use.

Body opening 160 may terminate in base end 130 (as shown in FIG. 5), or it may extend through base end 130 (as shown in FIG. 6). In the latter scenario, a fixing member 202 may be provided to fixedly couple second end 172 of elongated body 168 relative to base end 130. Where body opening 160 extends through base end 130, fixing member 202 may also be employed to retain elongated body 168 in an operational state within body opening 160. Fixing member 202 may include any now known or later developed structure to fixedly couple elongated body 168 relative to base end 130 in body opening 160, e.g., a plate with a fastener or weld for elongated body 168. In the FIG. 6 embodiment, elongated body 168 is not vibrating extensively with airfoil 134, so the majority of relative motion exists between wire mesh member(s) 180 and inner surface 182 of body opening 160. The compression of wire mesh member(s) 180 increases frictional engagement with inner surface 182 of body opening 160 to increase vibration damping.

Referring to FIG. 7, in another embodiment, more than one elongated body 168 can be used. Here, elongated bodies 168 include at least one first elongated body 168A having second end 172A thereof fixed relative to tip end 132 of body 128, and first, free end 170A thereof extending towards base end 130. Elongated bodies 168 also include at least one second elongated body 168B having second end 172B thereof fixed relative to base end 130 of body 128, and first, free end 170B thereof extending towards tip end 132. Any number of each elongated bodies 168A, 168B may be employed.

Wire mesh member(s) 180 surround both types of elongated bodies 168A, 168B to force each elongated body 168A, 168B into contact with at least one other elongated body 168A, 168B during operation of turbine nozzle 112 or blade 114. In this manner, each elongated body 168A, 168B is in contact with at least one other first elongated body 168A fixed to tip end 132 and/or at least one other second elongated body 168B fixed to base end 130.

Figure 10:
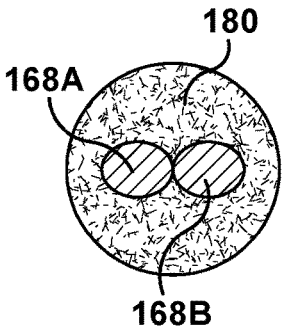
FIG. 10 shows a cross-sectional view, taken along view line A-A in FIG. 7, of a vibration damping system using a plurality of elongated bodies, according to embodiments of the disclosure.
Figure 11:
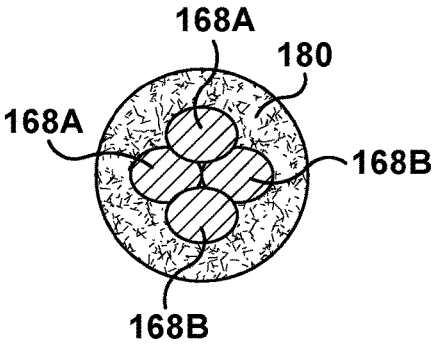
FIG. 11 shows a cross-sectional view, taken along view line A-A in FIG. 7, of a vibration damping system using a plurality of elongated bodies, according to other embodiments of the disclosure.

FIGS. 10 and 11 show cross-sectional views along view line A-A in FIG. 7 of various embodiments. FIG. 10 shows a cross-sectional view of an embodiment including one first elongated body 168A, and one second elongated body 168B. FIG. 11 shows a cross-sectional view including a plurality of (e.g., two) first elongated bodies 168A, and a plurality of (e.g., two) second elongated bodies 168B. Any number of each type of elongated body 168A, 168B may be used so long as they can be surrounded by wire mesh member(s) 180 to allow limited movement within body opening 160, e.g., circumferentially (into and out of page) and radially (up and down page).

In the FIG. 7 embodiment, a retention member 188 may be provided to retain wire mesh member(s) 180 relative to a length of first and second elongated bodies 168A, 168B. In one example, retention member 188 may be positioned on one or more of elongated bodies 168A and/or 168B, as in FIG. 6, to prevent wire mesh member(s) 180 from moving relative to a length of elongated bodies 168, e.g., because of centrifugal or vibrational forces of blades 114 or vibrational forces of nozzle 112. Alternatively, as shown in FIG. 7, retention member 188 may be provided by a closed end 212 of body opening 160 at tip end 132 in body 128. (Note, this retention member arrangement can also be used as an alternative for the FIG. 6 embodiment.) In FIG. 7, fixed end 172A of elongated body(ies) 168A may be fixed by being threaded or otherwise fastened into closed end 212 of body opening 160. Although not shown, fixed end 172B of elongated body(ies) 168B may be similarly fixed in base end 130.

Vibration damping system 120 may also optionally include, for blades 114, a compression member 220 movable along one or more of first elongated body(ies) 168A and second elongated body(ies) 168B to compress wire mesh member(s) 180 against retention member 188 during operation of turbine blade 114. Wire mesh member(s) 180 is/are positioned between retention member 188 and compression member 220. Compression member 220 may include any form of movable weight that can compress wire mesh member(s) 180, e.g., as occurs with the application of centrifugal force on blade 114 during use.

In the FIGS. 7, 10 and 11 embodiments, while some vibration damping occurs by way of elongated body(ies) 168A, 168B deflecting and some vibration damping occurs by wire mesh member(s) 180 frictionally engaging inner surface 182 of body opening 160, they are not the primary damping mechanism. Rather, the primary damping mechanism is elongated bodies 168A, 168B rubbing together. The force by which elongated bodies 168A, 168B engage can be controlled, in part, by the compression of wire mesh member(s) 180 by centrifugal force and/or compression member 220.

A method of damping vibration in turbine nozzle 112 or blade 114 according to various embodiments may include, during operation of turbine nozzle 112 or blade 114, providing various levels of different vibration damping. For example, a method may damp vibration by deflection of elongated body(ies) 168 disposed radially in body opening 160 and extending between tip end 132 and base end 130 of body 128 of turbine nozzle 112 or blade 114. As noted, each elongated body(ies) 168 may include first, free end 170 and second end 172 fixed relative to base end 130 or tip end 132 of body 128. The method may also damp vibration by frictional engagement of wire mesh member(s) 180 surrounding elongated body(ies) 168 with inner surface 182 of body opening 160. The knitted nature of wire mesh member(s) 180 may create friction, thus dissipating the input energy from the vibration. The frictional forces restrict motion of elongated body(ies) 168, thus reducing displacement. For rotating blades 114, damping of vibration by frictional engagement may be increased, where desired, by compressing wire mesh member(s) 180 to increase a force of frictional engagement of wire mesh member(s) 180 with inner surface 182 of body opening 160.

In certain embodiments, like those shown in FIGS. 7, 10 and 11, which include multiple types of elongated bodies 168A, 168B, the method may also include damping vibration by frictionally engaging each of elongated bodies 168A, 168B with one or more other elongated bodies 168A, 168B. In the FIG. 7 embodiment, for blades 114, compressing wire mesh member(s) 180 may result in increasing the damping of vibration by increasing a force of the frictional engagement of wire mesh member(s) 180 with inner surface 182 of body opening 160, and increasing the damping of vibration by increasing a force of the frictional engagement of each of elongated bodies 168A, 168B with one or more other elongated bodies 168A, 168B.

Assembly of vibration damping system 120 and retention of wire mesh member(s) 180 in body opening 160 relative to a length of elongated body 168 of vibration damping element(s) 166 can be carried out in a number of ways. As noted, wire mesh member(s) 180 are sized to achieve an interference fit with inner surface 182 of body opening 160 in an operative state to provide vibration damping. In one non-limiting example, wire mesh member 180 may have an outer dimension (ODM), e.g., outer diameter, in an operative state of approximately 7.6 millimeters (mm) and body opening 160 may have an inner dimension (IDB), e.g., inner diameter, of approximately 6.9 mm. In one approach, wire mesh member(s) 180 are positioned on elongated body(ies) 168 and forced into body opening 160, perhaps with the aid of a lubricant such as graphite powder.

In some cases, the forceful insertion can displace wire mesh member(s) 180 or cause damage to the members. Hence, it may be difficult to position each wire mesh member 180 in body opening 160, and it may be difficult to position each wire mesh member 180 in the desired longitudinal position along elongated body(ies) 168 and achieve the interference fit. At the same time, over-compression of wire mesh member(s) 180 can occur if one or more wire mesh member(s) 180 are allowed to slide or compress too much relative to a length of elongated body(ies) 168. Over-compression can also occur where a particular wire mesh member 180 is too long, resulting in one end 189 (FIG. 8) thereof being compressed significantly more than an opposing end 189 (FIG. 8) thereof.

Wire mesh member(s) 180 may be assembled and retained in position or limited in movement using a variety of techniques. For example, as described relative to FIGS. 5 and 6, a retention member 188 may be positioned on elongated body 168, e.g., as a wider part thereof, to allow limited sliding movement (and limited compression) of at least one wire mesh member 180 relative to a length of elongated body 168, i.e., longitudinally along elongated body 168 and radially relative to an axis of turbine 108 (FIG. 1). For assembly, wire mesh member(s) 180 may be positioned on elongated body 168 and collectively inserted with elongated body 168 into body opening 160. Alternatively, elongated body 168 may be fixed in body opening 160, and wire mesh member 180 can be forced onto, and perhaps along, elongated body 168 until it meets retention member 188. Where an end of body opening 160 acts as a retention member 188, as in FIG. 7, wire mesh member(s) 180 may be positioned in body opening 160, and elongated body(ies) 168 inserted into the wire mesh member(s) 180. In any event, in the examples shown in FIGS. 5-7, retention member 188 of retention system 187 is external of wire mesh member(s) 180 and abuts an end 189 (FIG. 8) of wire mesh member(s) 180 to position it/them in an operative state in body opening 160.

Referring to FIGS. 12-16, additional embodiments of retention system 187 with retention member(s) 188 for vibration damping elements 166 will now be described. In these embodiments, as in previous embodiments, retention member 188 is on elongated body 168 to fix wire mesh member 180 in body opening 160 of turbine nozzle 112 or blade 114 in an operative state. However, retention member(s) 188 in these embodiments engage within mesh opening 186 (FIGS. 8-9) to better secure wire mesh member(s) 180 in the operative state. While these embodiments will be described as mutually exclusive of retention member(s) 188 in FIGS. 5-7, it will be recognized that any of the various embodiments may be used together.

Figure 12:
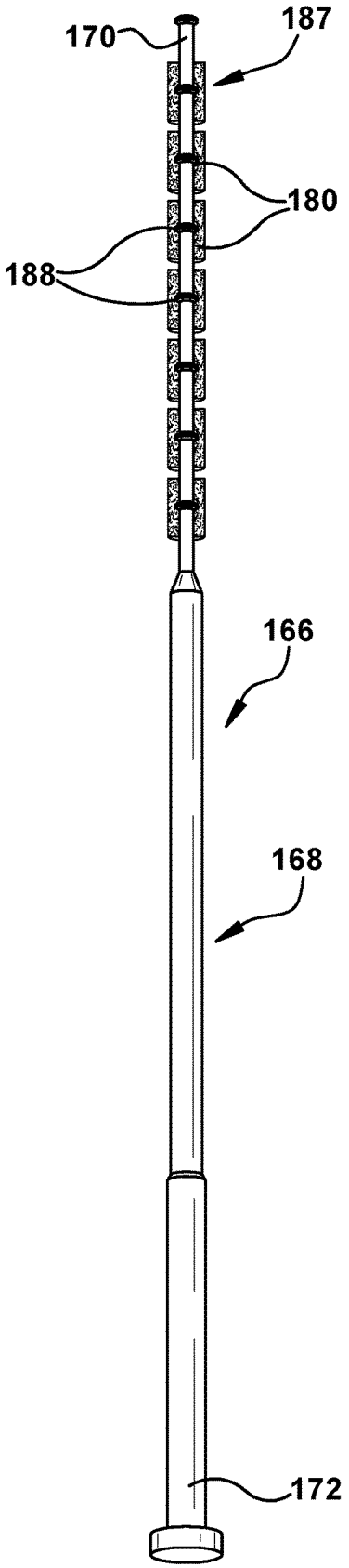
FIG. 12 shows a perspective view of an elongated body for a vibration damping element including a wire mesh member retention system, according to embodiments of the disclosure.
Figure 13:
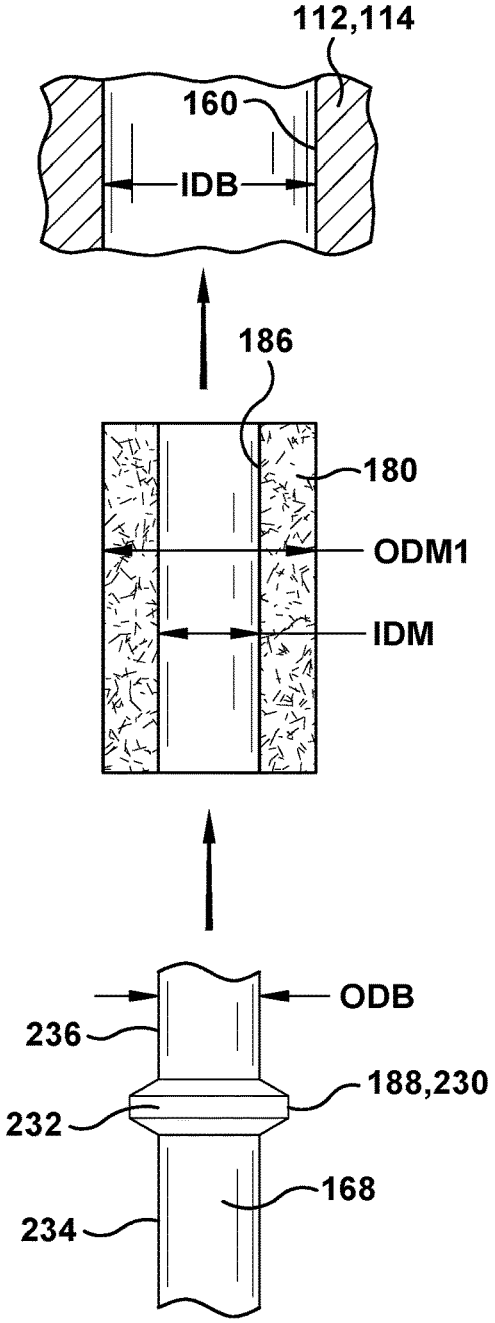
FIG. 13 shows an exploded, schematic cross-sectional view of a wire mesh member retention system prior to assembly, according to embodiments of the disclosure.

The FIGS. 12-16 embodiments enable a method of assembling vibration damping system 120 in turbine nozzle 112 or blade 114 that includes positioning wire mesh member(s) 180 in body opening 160 prior to positioning elongated body 168 therein. As shown in FIG. 8, wire mesh member(s) 180 have mesh opening 186 therein having inner dimension (IDM) and (first) outer dimension (ODM). As shown in FIG. 13, outer dimension ODM of wire mesh member(s) 180 may be sized to be less than an inner dimension (IDB) of body opening 160. Hence, wire mesh member(s) 180 slide freely and easily in body opening 160 in turbine nozzle 112 or blade 114 in the inoperative state, i.e., in which they are not fixed by a retention member 188. Any number of wire mesh member(s) 180 can be positioned in body opening 160 in this manner. The method may then include positioning elongated body 168 within respective mesh opening(s) 186 of wire mesh member(s) 180 within body opening 160.

Figure 14:
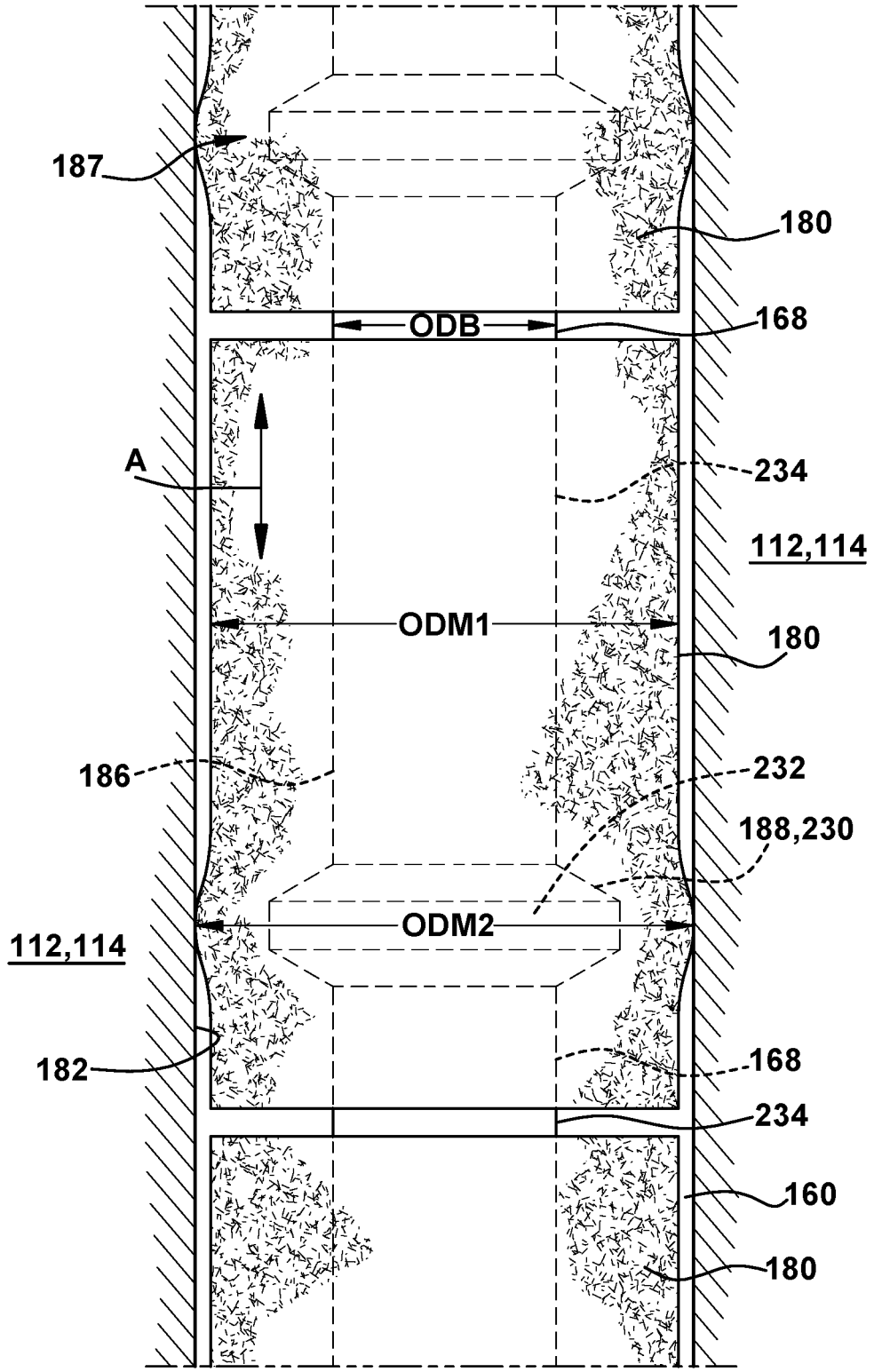
FIG. 14 shows a schematic cross-sectional view of a wire mesh member retention system of FIG. 13 after assembly.

As shown for example in FIG. 14, during the assembly process, retention member(s) 188 on elongated body 168 are used to fix wire mesh member(s) 180 relative to a length of elongated body 168 in an operative state in body opening 160 of turbine nozzle 112 or blade 114 by creating a (second) larger outer dimension (ODM2) in wire mesh member(s) 180 that frictionally engages with inner surface 182 of body opening 160 in turbine nozzle 112 or blade 114. The method may also include, as shown in FIGS. 5 and 6, fixing elongated body 168 relative to one of base end 130 and tip end 132 such that second end 172 of elongated body 168 is fixed relative to base end 130 or tip end 132 and first end 170 remains free (i.e., unfixed).

FIG. 12 shows a perspective view of elongated body 168 including a retention system 187; FIG. 13 shows an exploded, schematic cross-sectional view of retention system 187 in FIG. 12 before assembly; and FIG. 14 shows a schematic cross-sectional view of retention system 187 of FIG. 13 after assembly and positioning in body opening 160. In this embodiment and as shown in FIGS. 13 and 14, each retention member 188 includes a protrusion 230 on a first portion 232 of an outer surface 234 of elongated body 168. Elongated body 168 also includes a second portion 236 on outer surface 234 where protrusion 230 is not present. As shown in FIG. 13, wire mesh member(s) 180 have a first outer dimension (ODM1) and mesh opening 186 has an inner dimension (IDM) in an inoperative state, i.e., apart from an elongated body 168 (see also FIGS. 8-9). In the inoperative state shown in FIG. 13, inner dimension (IDM) of mesh opening 186 in a first section of wire mesh member 180 may be larger than outer dimension (ODB) of second portion 236 of elongated body 168 to allow wire mesh member 180 to slide freely over second portion 236 of elongated body 168. Additionally, first outer dimension (ODM1) of wire mesh member 180 may be smaller than inner dimension (IDMB) of body opening 160 so it can slide freely in body opening 160 of turbine nozzle 112 or blade 114. In this manner, during assembly, wire mesh member(s) 180 can be positioned in body opening 160, and elongated body 168 engaged into wire mesh member 180 in body opening 160.

As shown in FIG. 14, as insertion of elongated body 168 into wire mesh member(s) 180 occurs, protrusion(s) 230 expands wire mesh member(s) 180 in the first section thereof to create second, larger outer dimension (ODM2) therein. To attain an operative state, positioning of elongated body 168 may include engaging protrusion(s) 230 within inner dimension (IDM) of mesh opening 186 in the first section of wire mesh member(s) 180 to create second, larger outer dimension (ODM2) on wire mesh member(s) 180. That is, protrusion(s) 230 engage within inner dimension (IDM) (FIG. 13) of mesh opening 186 in the first section of wire mesh member(s) 180 to create second, larger outer dimension (ODM2) on wire mesh member(s) 180. The first section of wire mesh member 180 is compressed and fixed relative to a length of elongated body 168 where protrusion(s) 230 exist, i.e., in an operative state in an interference fit.

Where protrusion 230 does not exist, a second section of wire mesh member 180 different than the first section is not compressed, and wire mesh member 180 may slide freely and stretch relative to second portion 236 of elongated body 168. That is, wire mesh member 180 is allowed to stretch (see double-headed arrow A in FIG. 14) over second portion 236. Hence, wire mesh member(s) 180 surrounds elongated body 168 and has first outer dimension ODM1 in an inoperative state. Where protrusion(s) 230 exist, wire mesh member(s) 180 has second, larger outer dimension ODM2 in an operative state.

As shown in FIG. 14, in the operative state, wire mesh member 180 frictionally engages with inner surface 182 of body opening 160 in turbine nozzle 112 or blade 114 to damp vibration, i.e., where protrusion 230 exists. Protrusion 230 may have any shape necessary to allow sliding insertion into, and outward compression of, wire mesh member(s) 180 during assembly. Protrusion(s) 230 may extend any extent around and/or along elongated body 168 to create the desired second outer dimension (ODM2). In the exemplary embodiment, protrusion(s) 230 may extend symmetrically around the full circumference of elongated body 168, although such symmetry is not required. Any number of protrusion(s) 230 may be provide on elongated body 168, e.g., one for each wire mesh member 180. The FIGS. 12-14 embodiments can also use a retention member 188 like that shown in FIGS. 5 and 6.

It will be recognized that the FIGS. 12-14 embodiment may also be used in a method in which wire mesh member(s) 180 are positioned on elongated body 168 before insertion into body opening 160. That is, each wire mesh member 180 may be positioned over a respective protrusion 230 on elongated body 168 to create second larger outer dimension (ODM2), and then elongated body 168 and wire mesh member(s) 180 can be inserted into body opening 160 together, perhaps with the aid of a lubricant. The FIGS. 12-14 embodiment can also be used in circumstances in which elongated body 168 is fixed in body opening 160 first, and then wire mesh member(s) 180 are inserted over elongated body 168. This latter approach would require the section of elongated body 168 that includes protrusions 230 to be accessible through tip end 132 or base end 130 of turbine nozzle 112 or blade 114.

Figure 15:
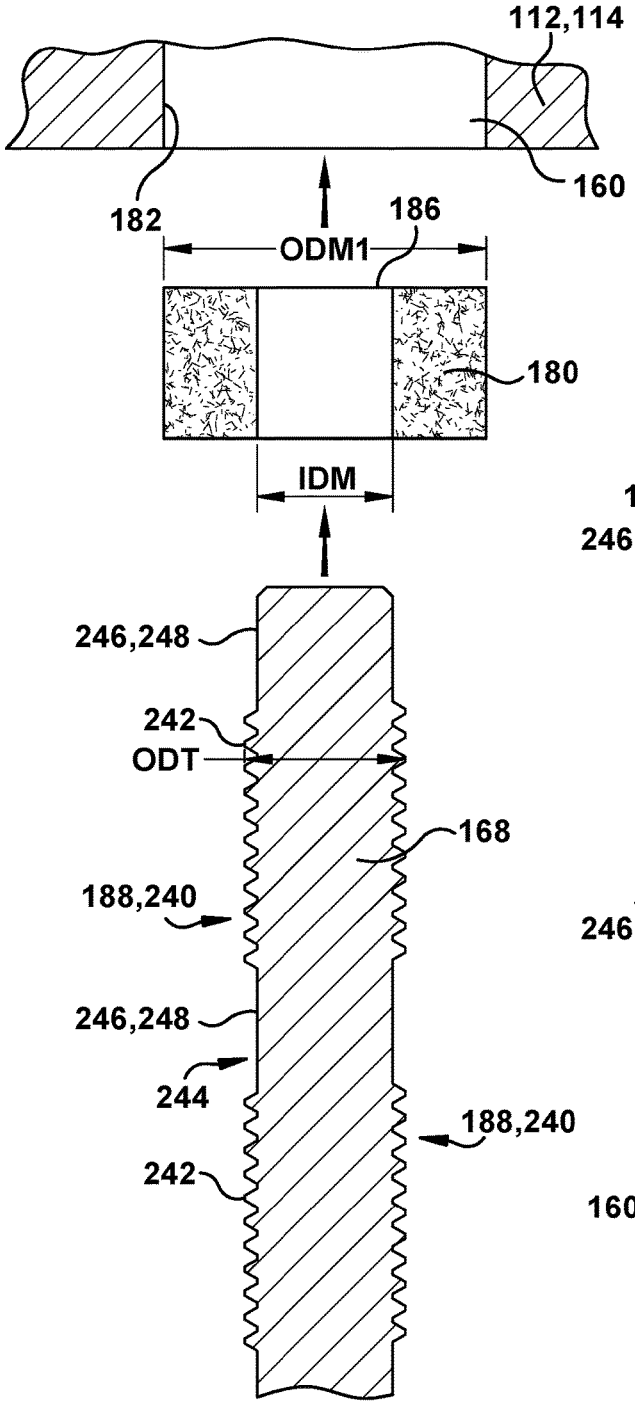
FIG. 15 shows an exploded, schematic cross-sectional view of a wire mesh member retention system prior to assembly, according to another embodiment of the disclosure.
Figure 16:
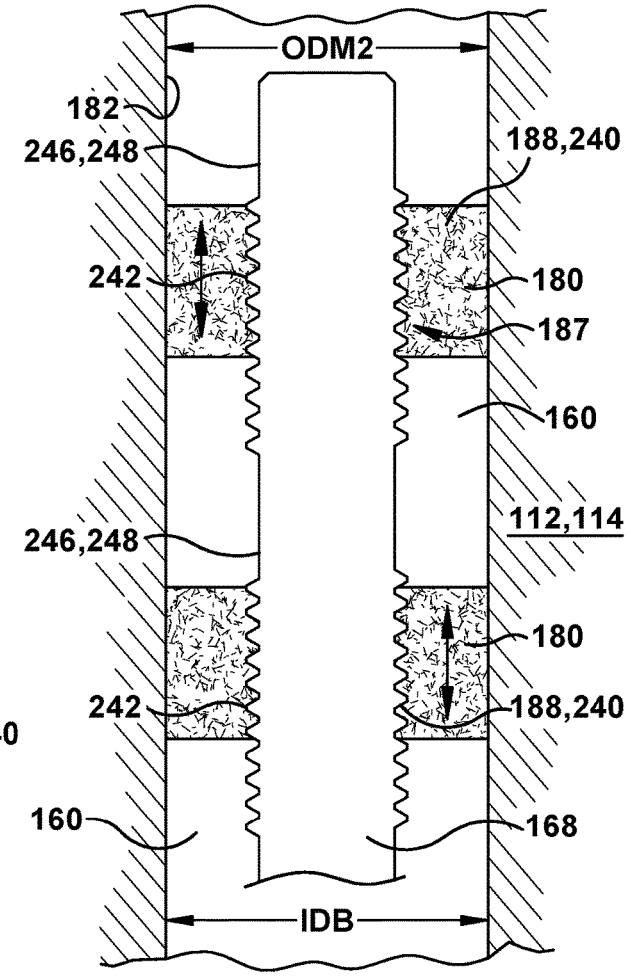
FIG. 16 shows a schematic cross-sectional view of a wire mesh member retention system of FIG. 15 after assembly.

FIG. 15 shows an exploded side view, and FIG. 16 shows an assembled side view of an elongated body 168 including a retention system 187 and retention member 188, according to another embodiment of the disclosure. In this embodiment, each retention member 188 includes a threaded section 240 on a first portion 242 of an outer surface 244 of elongated body 168. Elongated member 168 may also optionally include a non-threaded section 246 on a second portion 248 on outer surface 244 of elongated body 168. Where thread-free, second portion 248 is provided, inner dimension (IDM) of mesh opening 186 of wire mesh member 180 slides freely relative to second portion 248 of elongated body 168. Any number of threaded sections 240 can be provided to thread into a respective number of wire mesh members 180. Threaded section(s) 240 have an outer dimension (ODT) larger than inner dimension (IDM) (FIG. 15) of mesh opening 186 in wire mesh member 180 to create second, larger outer dimension (ODM2) (FIG. 16) on wire mesh member 180 in the operative state (FIG. 16), i.e., when threaded into wire mesh member(s) 180. For this embodiment, after positioning wire mesh member(s) 180 in body opening 160, the positioning of elongated body 168 may include threading first portion(s) 242 into mesh opening 186 to create second, larger outer dimension (ODM2) on wire mesh member(s) 180. Threaded portion(s) 240 can also find advantage in disassembling vibration damping element 166 by unthreading wire mesh member(s) 180.

Threaded section(s) 240 may have any threading format necessary to allow threaded insertion into, and outward compression of, wire mesh member(s) 180 during assembly. Threaded section(s) 240 may extend any extent around and/or along elongated body 168 to create the desired second outer dimension (ODM2). Any number of threaded section(s) 240 may be provided on elongated body 168, e.g., one for each wire mesh member 180. Threaded section 240 may also alternatively extend an entire length of elongated body 168. The FIGS. 15-16 embodiments can also use a retention member 188 like that shown in FIGS. 5 and 6.

It will be recognized that the FIGS. 15-16 embodiment may also be used in a method in which wire mesh member(s) 180 are positioned on elongated body 168 before insertion into body opening 160. That is, wire mesh member(s) 180 may be positioned over threaded sections 240 on elongated body 168 to create second larger outer dimension (ODM2), and then elongated body 168 and wire mesh member(s) 180 can be inserted into body opening 160 together, perhaps with the aid of a lubricant.

Vibration damping element 166 employing a rigid, elongated body 168 is not always desirable. For example, as noted, assembly can be challenging, especially where more than a couple of wire mesh members 180 are desired. As noted, wire mesh member(s) 180 are arranged in an interference fit with inner surface 182 of body opening 160 to provide vibration damping. Use of a rigid, elongated body 168 can present challenges in obtaining fixation of more than a couple wire mesh members 180. To address this challenge, embodiments of the disclosure may also include a vibration damping element 166 that includes a plurality of contacting members 250 that contact one another in a stacked or columnar manner within body opening 160. Contacting members 250 may include a plurality of damper pins 252, at least one of which may include a wire mesh member 180 thereon. In this manner, assembly may include positioning any number of damper pins 252 with wire mesh members 180 thereon sequentially into body opening 160 to create vibration damping element 166.

Figure 17:
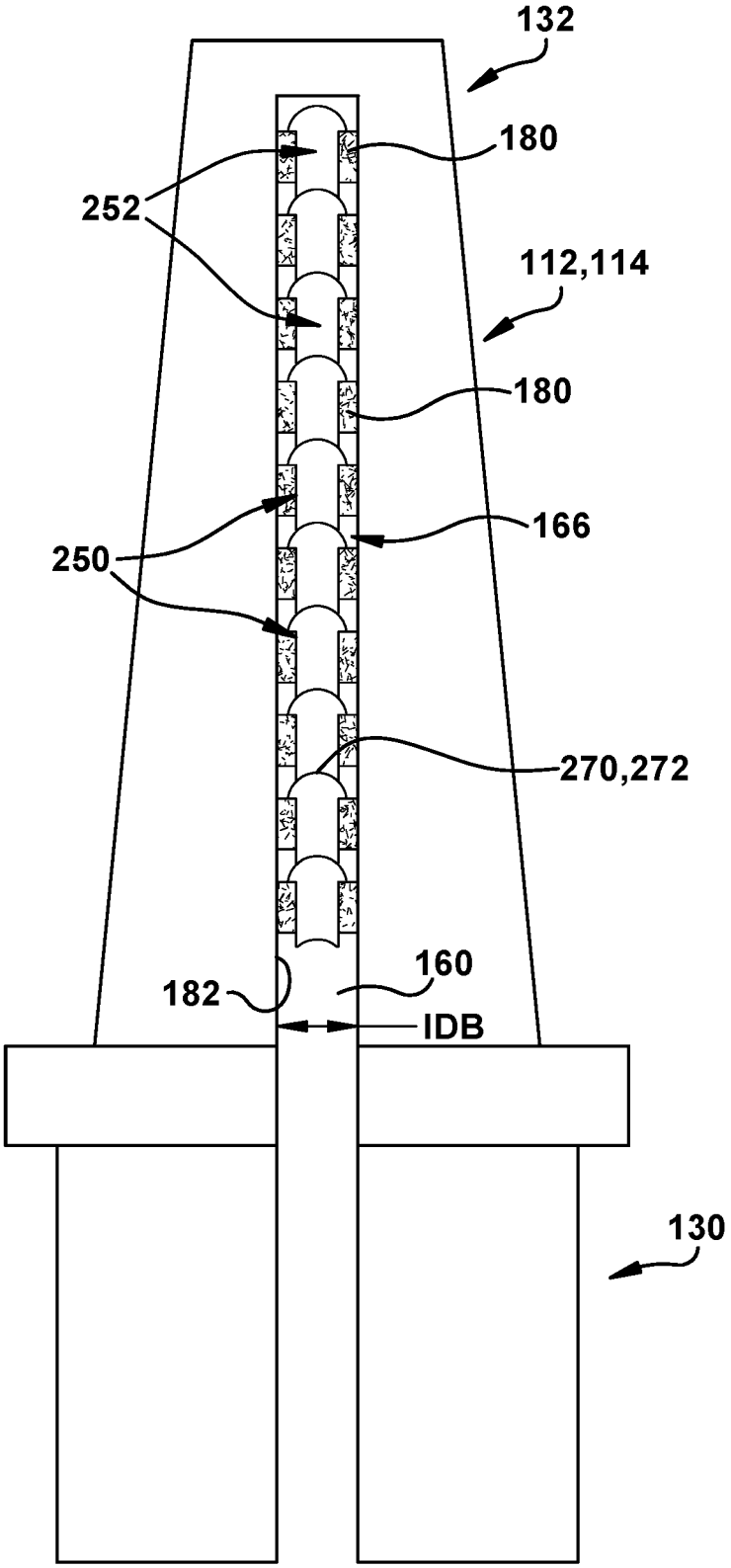
FIG. 17 shows a schematic cross-sectional view of a turbine nozzle or blade having a vibration damping system, according to other embodiments of the disclosure.

FIG. 17 shows a schematic cross-sectional view of turbine nozzle 112 or blade 114 having a vibration damping system 120 for a turbine nozzle 112 or blade 114. In this setting, vibration damping element 166 includes a plurality of contacting members 250 including a plurality of damper pins 252. Any number of damper pins 252 may be used to create vibration damping element 166. For example, in FIG. 17, ten (10) sequential damper pins 252 are used.

Figure 18:
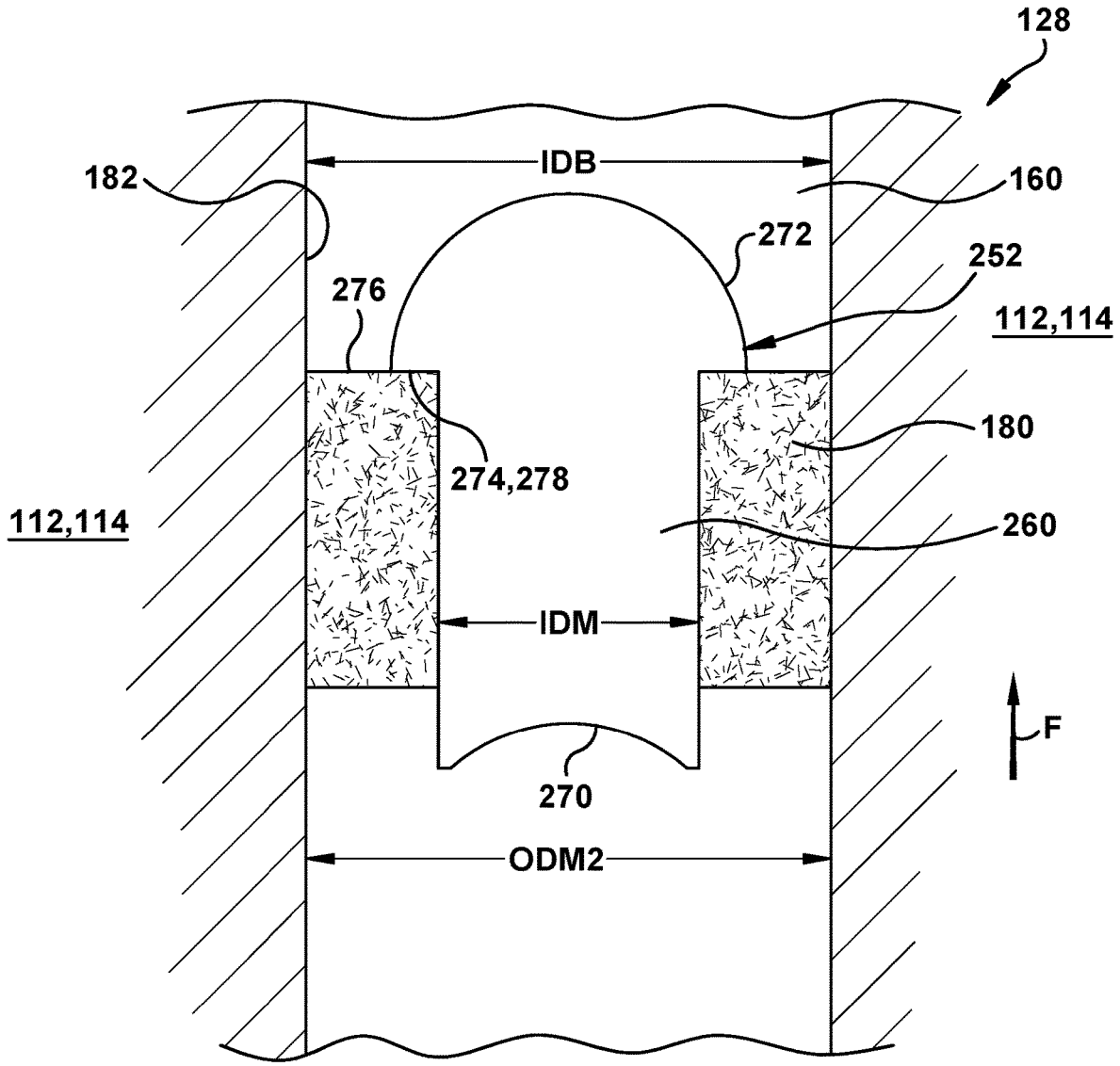
FIG. 18 shows an enlarged, schematic cross-sectional view of a damper pin and wire mesh member for a vibration damping system, according to other embodiments of the disclosure.

FIG. 18 shows a cross-sectional view of a damper pin 252 in a body opening 160 in a turbine nozzle 112 or blade 114. Each damper pin 252 includes a body 260. A wire mesh member 180, as described herein, surrounds body 260 of at least one of plurality of damper pins 252. Wire mesh member 180 may have an outer dimension (ODM2) sized to frictionally engage within body opening 160 having inner dimension (IDB) in turbine nozzle 112 or blade 114 to damp vibration. As shown in FIG. 17, damper pins 252 are arranged in a stacked or columnar fashion (somewhat similar to a spinal column) such that friction between damper pins 252 dampens vibration. Wire mesh members 180 allow damper pins 252 to be inserted in a centered fashion and forces pins 252 to move independently to dampen vibration by friction between adjacent damper pins 252. Friction between wire mesh members 180 and inner surface 182 of body opening 160 also dampens vibration. Damper pins 252 may be inserted in body opening 160 with force, perhaps with the aid of a lubricant, e.g., a graphite lubricant.

Figure 19:
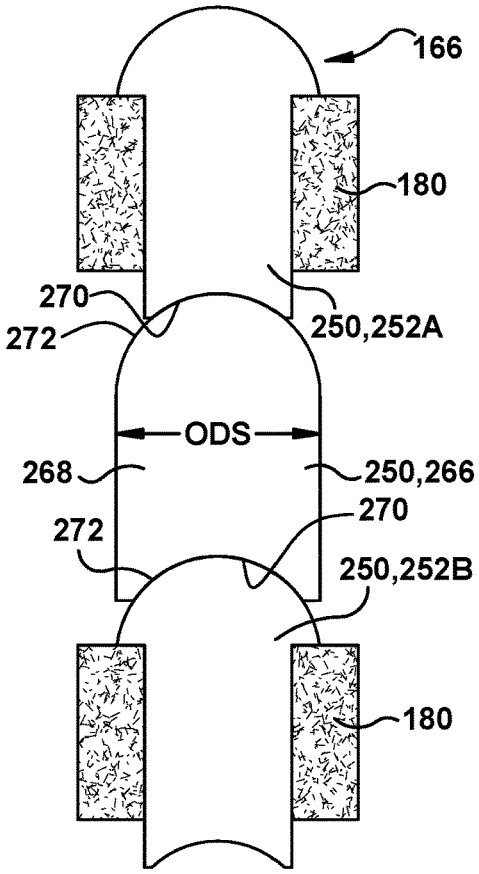
FIG. 19 shows an enlarged, schematic cross-sectional view of a pair of damper pins with wire mesh members and a spacing member for a vibration damping system, according to other embodiments of the disclosure.
Figure 22:
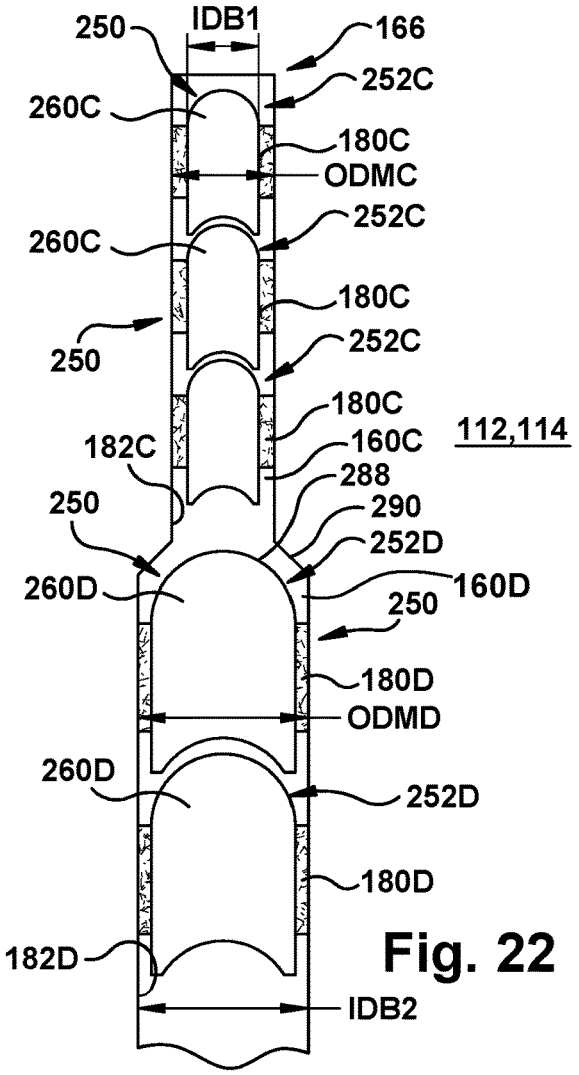
FIG. 22 shows an enlarged, schematic cross-sectional view of two sets of damper pins and wire mesh members having different sizes for a vibration damping system, according to embodiments of the disclosure.

FIG. 19 shows a cross-sectional view of another optional embodiment. In this embodiment, plurality of contacting members 250 may further include a spacing member 266 between a pair of damper pins 252. Spacing member(s) 266 have a body 268. Any number of spacing members 266 may be employed to lengthen vibration damping element 166. Spacing member(s) 266 are devoid of wire mesh member 180, i.e., there is no wire mesh member on body 268 of spacing member 266. Body 268 of spacing member(s) 266 can have any desired outer dimension (ODS) smaller than inner dimension (IDB) (FIG. 18) of body opening 160. Spacing member(s) 266 can have any desired length.

As shown in FIGS. 18 and 19, each spacing member 266 and each damper pin 252 are configured to slidingly engage along mating end surfaces 270, 272 of body 260 of damper pins 252 or body 268 of spacing member 266 to form frictional joints therebetween. That is, each spacing member 266 and each damper pin 252 have a body having a first mating end surface 270 and a second mating end surface 272 complementary to first mating end surface 270. The mating end surfaces 270, 272 of spacing member 266 each slidingly engage with a complementary mating end surface 270, 272 of the pair adjacent damper pins 252 to form a pair of frictional joints. In the example shown in FIGS. 18 and 19, mating end surfaces 270, 272 have a concave end surface 270 and a convex end surface 272 complementary to concave end surface 270. That is, concave end surface 270 and convex end surface 272 each have a radius of curvature that allows them to slidingly engage to form a pair of frictional joints. As shown in FIG. 17, concave end surface 270 and convex end surface 272 of damper pins 252 each may slidingly engage with a complementary convex end surface 272 and concave end surface 270 of adjacent damper pins 252 to form a frictional joint. As shown in FIG. 19, where spacing member(s) 266 are used, concave end surface 270 and convex end surface 272 of body 268 of spacing member(s) 266 each may slidingly engage with a complementary convex end surface 272 and concave end surface 270 of the pair of damper pins 252A, 252B adjacent thereto to form frictional joints. Various shapes of mating end surfaces 270, 272 are possible.

Referring to FIG. 18, where necessary, convex end surface 272 and/or concave end surface 270 of each damper pin 252 may include a retention member 274 engaging with a longitudinal end 276 of a respective wire mesh member 180 to prevent wire mesh member 180 from moving and/or compressing relative to a length of the respective body 260 of damper pin 252. In one example, retention member 274 includes an enlarged surface 278 of one of ends 270, 272 (272 as shown) that holds wire mesh member 180 on body 260 against a radial centrifugal force F on, for example, a turbine blade 114. Other forms of retention member 274 may also be employed.

Figure 20:
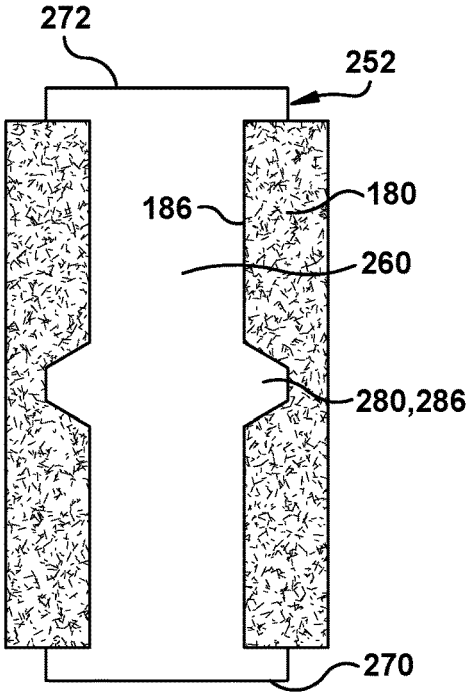
FIG. 20 shows an enlarged, schematic cross-sectional view of a damper pin and wire mesh member for a vibration damping system, according to another embodiment of the disclosure.
Figure 21:
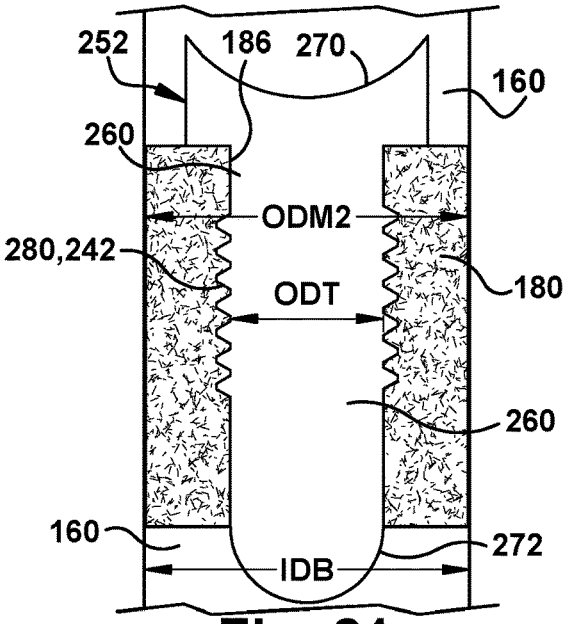
FIG. 21 shows an enlarged, schematic cross-sectional view of a damper pin and wire mesh member for a vibration damping system, according to other embodiments of the disclosure.

FIGS. 20 and 21 show cross-sectional views of an alternative embodiment of damper pins 252. In FIGS. 20 and 21, similar to the FIGS. 12-17 embodiments, body 260 of each of damper pins 252 may include a retention member 280 engaging within mesh opening 186 in the respective wire mesh member 180 to fix wire mesh member 180 relative to a length of the respective body 260 of damper pin 252. FIG. 20 shows a retention member 280 in the form of a protrusion 286, similar to that described relative to FIG. 15. FIG. 21 shows a retention member 280 in the form of threaded section 240, similar to that described relative to FIGS. 15-16. Here, retention member 280 includes a threaded section 240 on an outer surface of body 260 of the respective damper pin 252. Threaded section 240 has an outer dimension (ODT) larger than an inner dimension (IDM) (FIG. 8) of mesh opening 186 of wire mesh member 180 to create a larger outer dimension (ODM2) on wire mesh member 180 sized for frictionally engage with inner dimension (IDB) of body opening 160.

Figure 25:
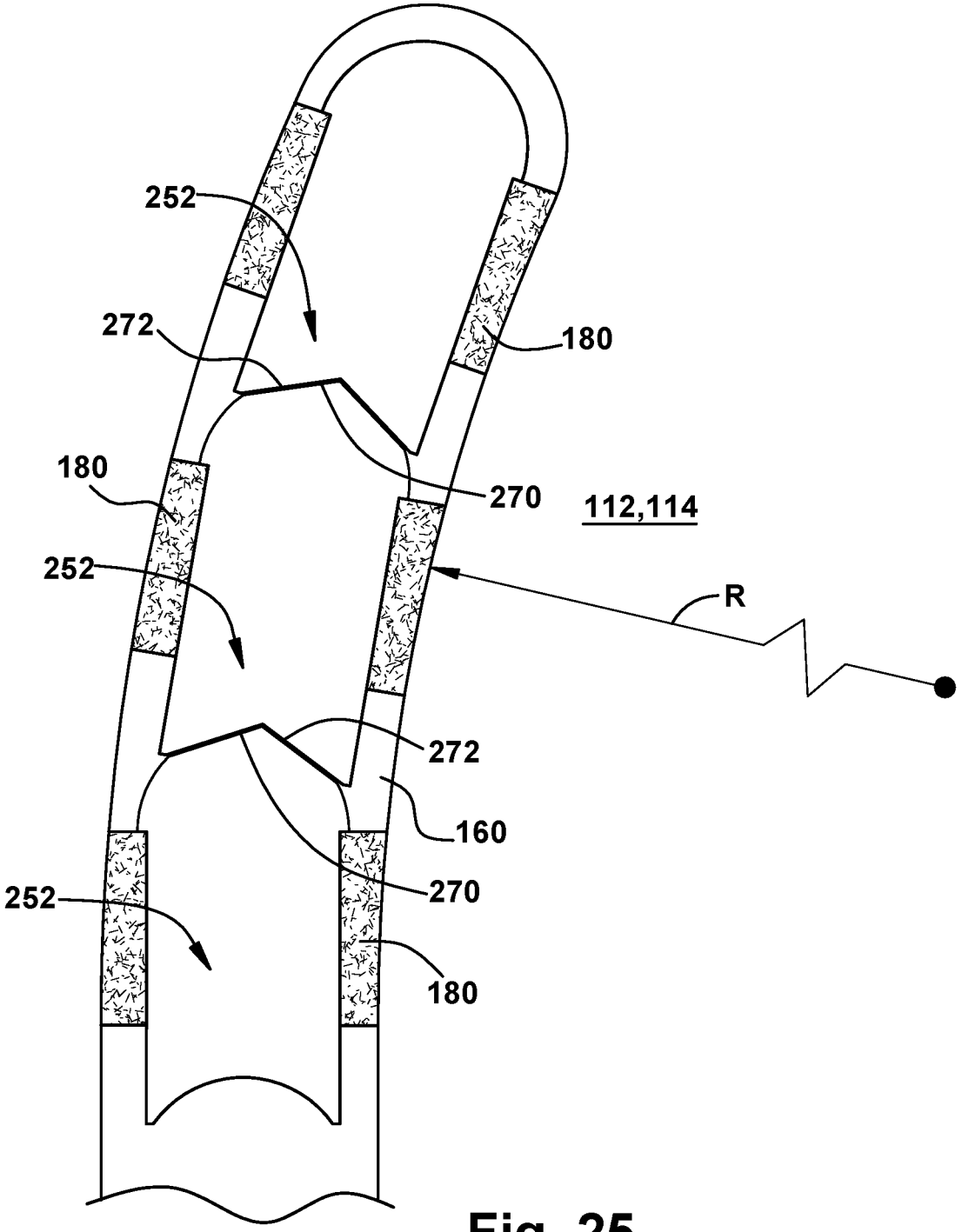
FIG. 25 shows a schematic cross-sectional view of a vibration damping system including a damper pin and wire mesh member in a body opening that is curved, according to additional embodiments of the disclosure.

FIG. 20 also shows that other shapes than rounded convex and concave ends 270, 272 may be employed for the mating surfaces. For example, as shown in FIG. 20, ends 270, 272 can be planar. FIG. 25 shows another option in which ends 270, 272 are conical or frusto-conical. FIG. 21 also shows that the position of mating surfaces 270, 272, such as but not limited to convex end surface 272 and concave end surface 270 can be switched. In FIG. 21, in contrast to the arrangement in FIG. 18, convex end surface 272 is on the radial inner end of body 260 and concave end surface 270 is on the radially outer end of body 260. Any of the varieties of mating surfaces 270, 272 described herein can be switched in this manner.

Damper pins 252 also are advantageous to allow vibration damping with contiguous body openings 160 having different sizes. In this setting, as shown for example in the schematic cross-sectional view of FIG. 22, vibration damping element 166 includes contacting members 250 having more than one plurality (set) of damper pins 252C, 252D. In the example shown, vibration damping element 166 includes first plurality of damper pins 252C in a first body opening 160C, and a second plurality of damper pins 252D in a second, contiguous body opening 160D. First body opening 160C has a different inner dimension than second body opening 160D (e.g., IDB1<IDB2). Each damper pin 252C, 252D includes a body 260C, 260D, respectively, as previously described. A first wire mesh member 180C surrounds body 260C of at least one of first plurality of damper pins 252C (shown with all three having them and no spacing member). Wire mesh member(s) 180C has a first outer dimension (ODMC) sized to frictionally engage with an inner surface 182C of first body opening 160C having a first inner dimension (IDB1) in turbine nozzle 112 or blade 114 to damp vibration therein. Each body 260C of damper pins 252C is sized appropriately for wire mesh members 180C.

Vibration damping element 166 including contacting members 250 also includes second plurality of damper pins 252D with each damper pin 252D having body 260D. A second wire mesh member 180D surrounds body 260D of at least one of the second plurality of damper pins 252D (shown with both pins 252D having them and no spacing member). Each body 260D of damper pins 252D is sized appropriately for wire mesh members 180D. Second wire mesh member(s) 180D have a second outer dimension (ODMD) for frictionally engaging with an inner surface 182D of second body opening 160D in turbine nozzle 112 or blade 114. In the example shown, second body opening 160D has a second, larger inner dimension (IDB2) than first inner dimension (IDB1) of first body opening 160C. Despite the different sizes, first body opening 160C and second body opening 160D are contiguous and may share a common longitudinal axis.

Damper pin sets 252C, 252D having different sizes can be advantageous to minimize weight of vibration damping element 166, while still maintaining a desired vibration damping performance. Any number of damper pin sets 252C, 252D may be employed with different sized body openings 160C, 160D. While not shown for clarity, contact members 250 may also include any number of spacing members 266 (FIG. 18).

Although not shown, larger damper pins 252D may engage with and load against smaller damper pins 252C via mating end surfaces 270, 272. However, as shown, larger damper pins 252D may be isolated from smaller damper pins 252C such that larger damper pins 252D do not load against smaller damper pins 252C. The isolation can be created in a variety of ways. In one example, shown in FIG. 22, second body opening 160D may be configured to engage with an end 288 of a terminating one of larger damper pins 252D, e.g., via a tapered surface 290 thereof.

Figure 23:
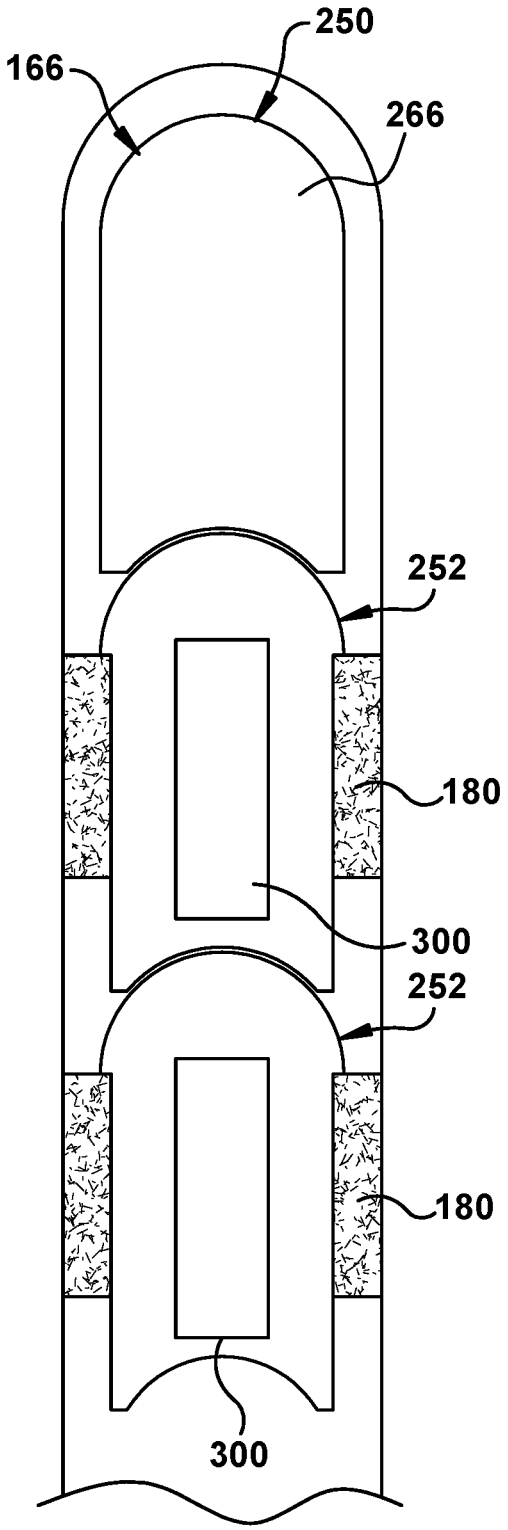
FIG. 23 shows a schematic cross-sectional view of damper pins having hollow regions therein for a vibration damping system, according to other embodiments of the disclosure.

As shown in the schematic cross-sectional view of FIG. 23, where it is desirable to lower the weight of vibration damping element 166, at least one contacting member 250 may include a hollow region 300 defined therein. In FIG. 23, hollow regions 300 are shown only in damper pins 252, but hollow regions 300 are equally applicable to spacing members 266. Hollow regions 300 can be applied to any embodiment described herein.

Figure 24:
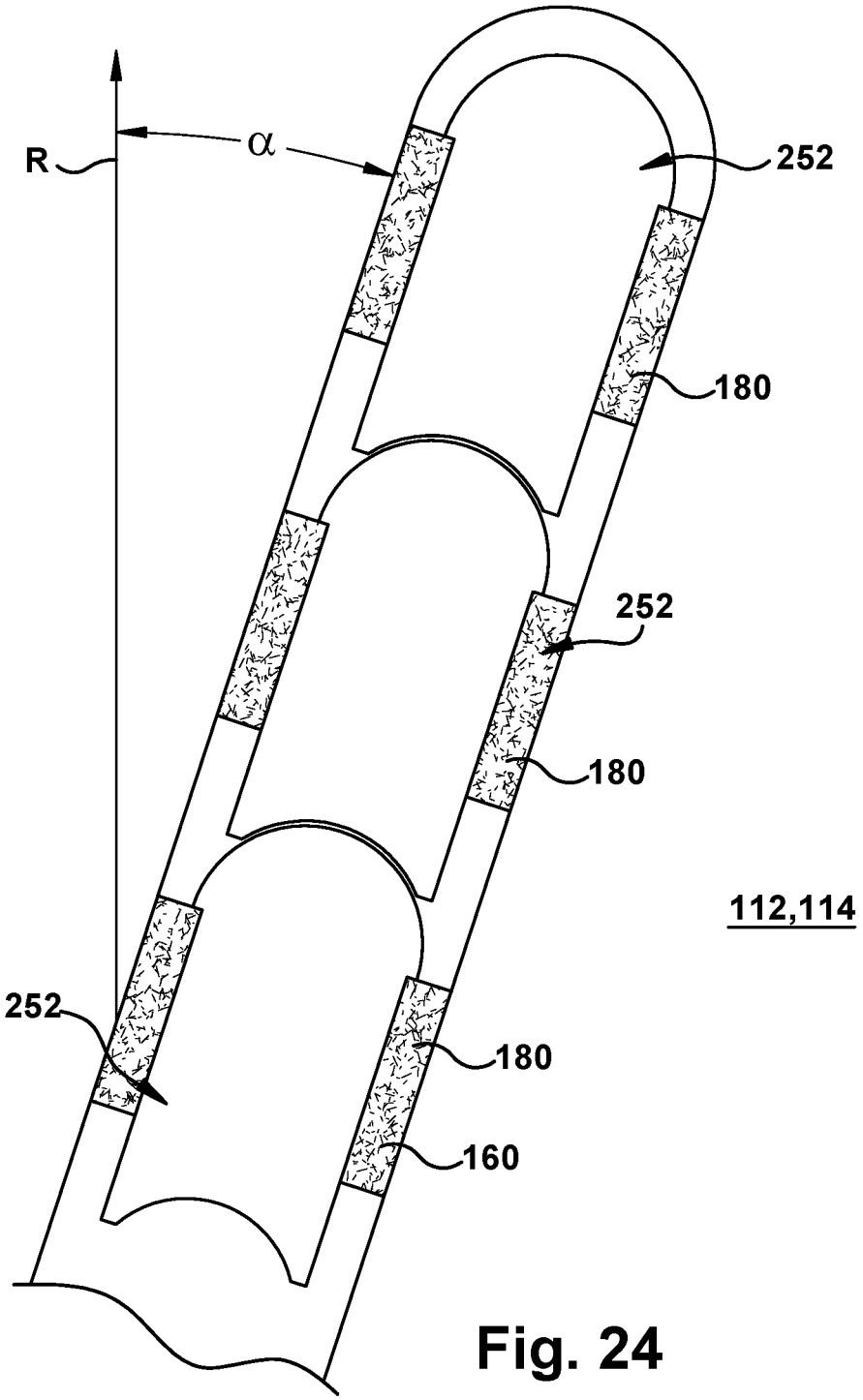
FIG. 24 shows a schematic cross-sectional view of a vibration damping system including a damper pin and wire mesh member in a body opening that is angled relative to a radial direction of a turbine nozzle or blade, according to additional embodiments of the disclosure.

FIG. 24 shows a schematic cross-sectional view of another optional embodiment. Another advantage of damper pins 252 is that each pin and respective wire mesh member 180 can bear its own weight. Consequently, damper pins 252 can be used in a body opening 160 in turbine nozzle 112 or blade 114 that extends at an angle α relative to a radial direction (R) of turbine nozzle 112 or blade 114. Angle α can be, for example, any angle between 1°-45°. As shown in FIG. 25, damper pins 252 can also be used in a body opening 160 in turbine nozzle 112 or blade 114 that extends in a curved manner relative to a radial direction (R) of turbine nozzle 112 or blade 114. Any radius of curvature R can be used.

It will be apparent that some embodiments described herein are applicable mainly to rotating turbine blades 114 that experience centrifugal force during operation and thus that may require certain structure to maintain high performance vibration damping. That said, any of the above-described embodiments can be part of a turbine nozzle 112 or blade 114.

Embodiments of the disclosure provide vibration damping element(s) 166 including elongated body(ies) 168 or a plurality of damper pins 252 with wire mesh member(s) 180 to reduce nozzle 112 or blade 114 vibration with a simple arrangement. A variety of retention systems may be used to maintain a position of wire mesh members 180. Vibration damping system 120 does not add much extra mass to nozzle(s) 112 or blade(s) 114, and so it does not add additional centrifugal force to blade tip end or require a change in nozzle or blade configuration.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," is not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described to best explain the principles of the disclosure and the practical application and to enable others of ordinary skill in the art to understand the disclosure for various embodiments with various modifications as are suited to the particular use contemplated.

What is claimed is:

1. A vibration damping element for a vibration damping system for a turbine nozzle or blade, comprising:

an elongated body;

a wire mesh member surrounding the elongated body and having a first outer dimension in an inoperative state and a second, larger outer dimension in an operative state, wherein in the operative state, the wire mesh member frictionally engages with an inner surface of a body opening in the turbine nozzle or blade to damp vibration, and in the inoperative state, the wire mesh member slides freely in the body opening in the turbine nozzle or blade; and a retention member on the elongated body to fix a first section of the wire mesh member relative to a length of the elongated body in the operative state in the body opening of the turbine nozzle or blade.

2. The vibration damping element of claim 1, wherein the retention member includes a protrusion on a first portion of an outer surface of the elongated body, the protrusion engaging within an inner dimension of a mesh opening in the first section of the wire mesh member to create the second, larger outer dimension on the wire mesh member in the operative state.

3. The vibration damping element of claim 2, wherein the elongated body includes a second portion on the outer surface thereof, wherein the mesh opening in a second section of the wire mesh member different than the first section slides freely relative to the second portion.

4. The vibration damping element of claim 1, wherein the retention member includes a threaded section on a first portion of an outer surface of the elongated body, the threaded section having an outer dimension larger than an inner dimension of a mesh opening in the first section of the wire mesh member to create the second, larger outer dimension on the wire mesh member in the operative state.

5. The vibration damping element of claim 4, wherein the retention member includes a non-threaded section on a second portion on the outer surface of the elongated body, wherein the inner dimension of the mesh opening in a second section of the wire mesh member different than the first section slides freely relative to the second portion.

6. A vibration damping system for a turbine nozzle or blade, comprising:

a body opening extending through a body of the turbine nozzle or blade between a tip end and a base end thereof; and a vibration damping element disposed in the body opening, the vibration damping element including:

an elongated body having a first, free end and a second end fixed relative to one of the base end and the tip end;

a wire mesh member surrounding the elongated body and having a first outer dimension in an inoperative state and a second, larger outer dimension in an operative state, wherein in the operative state, the wire mesh member frictionally engages with an inner surface of the body opening in the turbine nozzle or blade to damp vibration and in the inoperative state, the wire mesh member slides freely in the body opening in the turbine nozzle or blade; and a retention member on the elongated body configured to fix a first section of the wire mesh member relative to a length of the elongated body in the operative state in the body opening of the turbine nozzle or blade.

7. The vibration damping system of claim 6, wherein the retention member includes a protrusion on a first portion of an outer surface of the elongated body, the protrusion engaging with an inner dimension of a mesh opening in the first section of the wire mesh member to create the second, larger outer dimension on the wire mesh member in the operative state.

8. The vibration damping system of claim 7, wherein the retention member includes a second portion on the outer surface of the elongated body, wherein the inner dimension of the mesh opening in a second section of the wire mesh member different than the first section slides freely relative to the second portion.

9. The vibration damping system of claim 6, wherein the retention member includes a threaded section on a first portion of an outer surface of the elongated body, the threaded section having an outer dimension larger than an inner dimension of the first section of the wire mesh member to create the second, larger outer dimension on the wire mesh member in the operative state.

10. The vibration damping system of claim 9, wherein the elongated body includes a non-threaded section on a second portion on the outer surface of the elongated body, wherein the inner dimension of the mesh opening in a second section of the wire mesh member different than the first section slides freely relative to the second portion.

11. The vibration damping system of claim 6, wherein the second end of the elongated body is fixed relative to the tip end of the body, and the first, free end extends towards the base end.

12. The vibration damping system of claim 6, wherein the second end of the elongated body is fixed relative to the base end of the body of the turbine nozzle or blade, and the first, free end extends towards the tip end.

13. The vibration damping system of claim 6, wherein the wire mesh member includes a plurality of wire mesh members spaced along the elongated body, each wire mesh member engaging with a different portion of the inner surface of the body opening.

14. A method of assembling a vibration damping system in a turbine nozzle or blade, the method comprising:

positioning a wire mesh member in a body opening extending through a body of the turbine nozzle or blade between a tip end and a base end thereof, the wire mesh member having a mesh opening therein having an inner dimension and a first outer dimension that slides freely in the body opening in the turbine nozzle or blade in an inoperative state;

positioning an elongated body in the body opening and within the mesh opening of the wire mesh member, wherein a retention member on the elongated body fixes a first section of the wire mesh member relative to a length of the elongated body in an operative state in the body opening of the turbine nozzle or blade by creating a second, larger outer dimension in the wire mesh member that frictionally engages with an inner surface of the body opening in the turbine nozzle or blade; and fixing the elongated body relative to one of the base end and the tip end such that the elongated body has a first, free end and a second end fixed relative to the one of the base end and the tip end.

15. The method of claim 14, wherein the retention member includes a protrusion on a first portion of an outer surface of the elongated body, and the positioning of the elongated body includes engaging the protrusion within the inner dimension of the mesh opening in the first section of the wire mesh member to create the second, larger outer dimension on the wire mesh member.

16. The method of claim 15, wherein the retention member includes a second portion on the outer surface of the elongated body, wherein the inner dimension of the mesh opening in a second section of the wire mesh member different than the first section slides freely relative to the second portion.

17. The method of claim 14, wherein the retention member includes a threaded section on a first portion of an outer surface of the elongated body, the threaded section having an outer dimension larger than the inner dimension of the mesh opening in the first section of the wire mesh member, and wherein the positioning of the elongated body includes threading the first portion into the mesh opening to create the second, larger outer dimension on the wire mesh member.

18. The method of claim 17, wherein the retention member includes a non-threaded section on a second portion on the outer surface of the elongated body, wherein the inner dimension of the mesh opening in a second section of the wire mesh member different than the first section slides freely relative to the second portion.

* * * * *